US007391986B2

(12) United States Patent
Ushio et al.

(10) Patent No.: US 7,391,986 B2
(45) Date of Patent: Jun. 24, 2008

(54) IMAGE FORMING SYSTEM FOR FORMING IMAGES ON ONE SIDE OR BOTH SIDES OF RECORDING MEDIA

(75) Inventors: Masaru Ushio, Hachioji (JP); Takao Kurohata, Hino (JP); Masahiro Osawa, Hamura (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 266 days.

(21) Appl. No.: 11/192,163

(22) Filed: Jul. 28, 2005

(65) Prior Publication Data

US 2006/0110177 A1 May 25, 2006

(30) Foreign Application Priority Data

Nov. 19, 2004 (JP) ..... 2004-336392

(51) Int. Cl.
*G03G 15/00* (2006.01)

(52) U.S. Cl. ..... 399/84; 399/363; 399/364; 399/374

(58) Field of Classification Search ..... 399/81–82, 399/84, 363, 364, 374
See application file for complete search history.

(56) References Cited

U.S. PATENT DOCUMENTS 5,713,061 A * 1/1998 Yoshioka ..... 399/364
2003/0038988 A1* 2/2003 Anderson et al. ..... 358/474
2004/0125394 A1* 7/2004 Terao et al. ..... 358/1.13

FOREIGN PATENT DOCUMENTS

JP 2002-223336 A 8/2002
JP 2002-359720 A 12/2002

* cited by examiner

*Primary Examiner*—David M. Gray
*Assistant Examiner*—Ryan D. Walsh
(74) *Attorney, Agent, or Firm*—Frishauf, Holtz, Goodman & Chick, P.C.

(57) ABSTRACT

An image forming system includes a document conveying section that reversely conveys documents such that a front side and back side of the documents pass through a reading position, an image reading section for reading images on the documents conveyed to the reading position and generating image data, an image forming section for forming images on recording media, according to the image data, an input section for inputting designation whether the images are to be formed on both sides or on one side of the recording media, and a control section for controlling image reading by the image reading section and image forming by the image forming section, wherein the control section controls the image forming section to form an image according to image data in a condition where a single job includes both single-sided and double-sided image recording, correspondingly to the designation inputted via the input section.

15 Claims, 14 Drawing Sheets

FIG. 7

| | | | |
|---|---|---|---|
| JOB DATA | | SET NUMBER OF COPIES | 1 |
| | | OUTPUT NUMBER OF COPIES | 0 |
| | | COPY MODE | DOUBLE-SIDE→DOUBLE-SIDE◆1 |
| | | INTER-SHEET MODE | PRESENT◆2 |
| | | INSERTION MODE | SINGLE-SIDE / BLANK SHEET◆3 |
| | | DESIGNATED PAGE 1 | 2◆4 |
| | | DESIGNATED PAGE 2 | 0 |
| | | ~ | |
| | | DESIGNATED PAGE 30 | 0 |
| | | TRAY USED (MAIN TEXT) | TRAY 2◆5 |
| | | INSERTION SHEET TRAY | MANUAL FEED◆6 |
| | | FEEDING SHEET INSERTION POINTER | ◆7 |
| | | SECOND FEEDING SHEET INSERTION POINTER | ◆8 |
| | | NUMBER OF READ IMAGES | ◆9 |
| | | OUTPUT PAGE | ◆10 |
| PAGE DATA | PAGE 1 | IMAGE STORAGE ADDRESS | ◆11 |
| | PAGE 2 | IMAGE STORAGE ADDRESS | |
| | ~ | | |
| | PAGE N | IMAGE STORAGE ADDRESS | |

*1. A COPY MODE SELECTED ON THE BASIC SCREEN IS SET. (SINGLE-SIDE → SINGLE-SIDE, SINGLE-SIDE → DOUBLE-SIDE, DOUBLE-SIDE → SINGLE-SIDE, DOUBLE-SIDE → DOUBLE-SIDE)

*2. STATUS BECOMES "PRESENT" WHEN THE INTER-SHEET MODE IS SELECTED FROM THE APPLICATION FUNCTIONS.

*3. INSERTION MODE IS SET BY DESIGNATION OF SINGLE-SIDE OR DOUBLE-SIDE, COPY OR BLANK SHEET FOR AN INSERTION SHEET.

*4. A PAGE HAVING BEEN SET IN PAGE SETTING IS SET. IN THIS EMBODIMENT, THERE ARE 30 SETTING POSITIONS AND 30 POSITIONS ARE SORTED AND STORED IN THE ASCENDING ORDER TO BE SET AS INSERTION PAGES 1-30.

*5. A TRAY IN THE SAME SIZE AS THE INSERTION TRAY IS SELECTED AUTOMATICALLY AS A TRAY FOR THE MAIN TEXT. IN THIS EMBODIMENT, TRAY 2 HAVING THE SAME SIZE AS THE MANUAL FEED TRAY AND HAVING THE HIGHEST PRIORITY LEVEL IS SELECTED.

*6. A TRAY SELECTED AS THE INSERTION TRAY IS SET. A MANUAL FEED TRAY IS SELECTED IN THIS EXAMPLE.

*7. THE POINTER INDICATES THE NUMBER STORING THE PAGE TO BE INSERTED NEXT FOR SHEET FEEDING, AND '1' IS SET AT THE TIME OF STARTING COPYING AND INCREMENTED BY +1 WHEN PAGE INSERTION IS EXECUTED.

*8. THE POINTER INDICATES THE NUMBER STORING THE PAGE TO BE INSERTED NEXT FOR THE SECOND SHEET FEEDING, AND '1' IS SET AT THE TIME OF STARTING COPYING AND INCREMENTED BY +1 WHEN PAGE INSERTION IS EXECUTED.

*9. THE POINTER IS SET TO '1' AT THE TIME OF STARTING COPYING AND INCREMENTED BY +1 AT SVV_OFF. THE POINTER INDICATES THE PAGE NUMBER OF THE IMAGE TO BE READ NEXT, AND THE DATA RELATED TO THE READ IMAGE IS STORED IN THE PAGE DATA AREA OF THIS NUMBER.

*10. THE NUMBER INDICATES THE PAGE NUMBER OF AN IMAGE TO BE OUTPUT NEXT, AND THE DATA RELATED TO THE IMAGE TO BE OUTPUT IS OBTAINED FROM THE DATA STORED IN THE PAGE DATA AREA OF THIS NUMBER.

*11. EACH IMAGE IS STORED IN THE IMAGE MEMORY IN A COMPRESSED FORMAT, AND THIS INDICATES THE STORAGE ADDRESS.

FIG. 12 ( a )
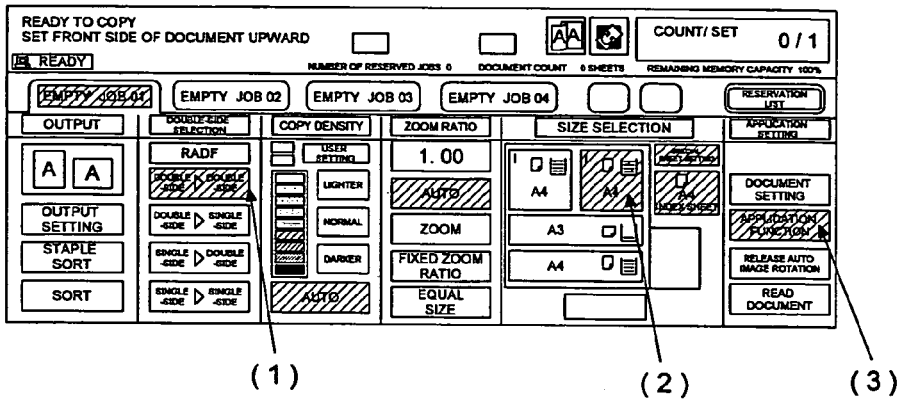
FIG. 12 ( b )
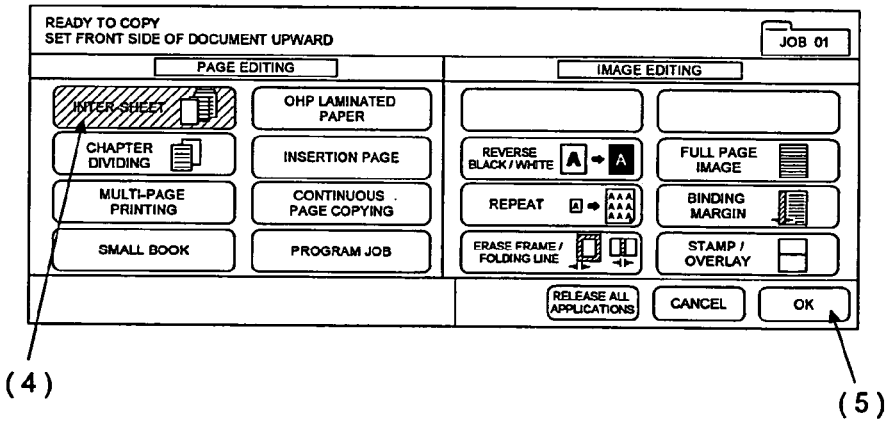
FIG. 12 ( c )
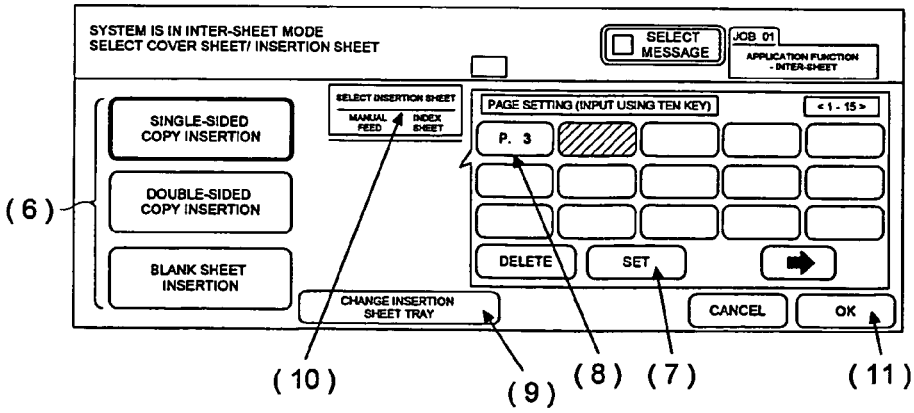

IMAGE FORMING SYSTEM FOR FORMING IMAGES ON ONE SIDE OR BOTH SIDES OF RECORDING MEDIA

FIELD OF THE INVENTION

The present invention relates to an image forming system that carries out image forming according to read image data or image data from outside.

BACKGROUND OF THE INVENTION

There are image forming devices such as copying machines that read images on both sides of a document sheet while conveying it and generate image data, and then carry out image forming on both sides of a recording sheet based on the image data.

The image reading section (scanner) in an image forming device of this type has a reading device such as a solid image pick-up device of a plurality of pixels along the main scanning direction, and the document is read in two dimensions along the main scanning direction and the sub scanning direction by moving the document along the sub scanning direction with respect to the reading device. Such a type that reads a document while transporting it in this manner is called "a static exposure flow type" or "a sheet through type", and this type will be referred to "a sheet through type" in this specification.

In an image forming device provided with an image reading section of this "sheet through type", since it is possible to read a document while an optical mirror and an illuminating lamp are fixed, this type is suitable for reading several document sheets in succession.

Further, in an image forming device of this type, it is possible to read images on both sides of a document by reversing the document, and also, to reverse a recording sheet and form images on both sides of the recording sheet.

[Patent Document 1]

Japanese Patent Application Laid Open No. 2002-223336 (Page 1, FIG. 1)

[Patent Document 2]

Japanese Patent Application Laid Open No. 2002-359720 (Page 1, FIG. 1)

By the art disclosed in Patent Document 1 mentioned above, it is possible to designate single-sided output or double-sided output, according to read image data for each page, and image forming output is carried out both on a single side and double sides in a mixture, according to designated information. However, nothing has been mentioned about an image reading section, and reading of documents in a mixture of single-sided documents and double-sided documents has not been considered.

For example, it is necessary to insert a blank sheet in documents if it is necessary to insert a blank sheet in an output of image forming. Further, in a double-sided image forming mode, there is a problem of a drop in productivity because even a blank insertion sheet on which no image is formed is necessary to be passed through a double-sided image forming path.

Further, in the art disclosed in Patent Document 2, when the inter-sheet mode of inserting index sheets is designated, and if normal documents and tab sheet documents are present in a mixture, count values during reading are stored, and sheet feeding for image forming is switched, according to the count values. By storing count values in such a manner, it is understood that there is an assumption that a user loads normal documents and tab sheet documents on a document mounting portion in a plural times to read the documents.

Further, in an actual image forming device even if double-sided reading and double-sided image forming are possible with normal documents and recording sheets, the operations will be single-sided reading and single-sided image forming in the case of tab sheets due to the projecting part of the tabs.

In a known image forming device described above, when carrying out double sided copying of documents including tab sheet documents in the inter-sheet mode, if there are N sheets of tab sheet documents, since tab sheet documents are not in a series, the user has to divide the documents into 2N+1 bundles and mount the bundles at the document mounting position alternately in plural times to have them read.

In other words, in this case, operation and control are necessary not as a single continuous job but as a programming job to be handled as 2N+1 multiple jobs. In such a programming job method, as the reading is not for a single integrated bundle, there is a problem that the productivity is sacrificed and the efficiency is low.

Further, there is also a problem that the task is tedious because the user has to load documents in several times.

Further, consideration is not given to carrying out a mixture of double-sided and single-sided image forming in a state where both single-side and double-side documents are present. In other words, also in this case, operation and control were necessary not as a single continuous job but as a programming job to be handled as several jobs. In this programming job method, there is a problem that the productivity is sacrificed and the efficiency is low because reading of documents is not for a single integrated bundle.

The case of a copying machine has been described above. In the case of image forming devices such as printers, etc., that receive image data from outside and carry out image forming, although it is possible to designate various types of settings regarding printing in an application program generating image data, consideration has not been given to operationability for designating a single-sided mode or double-sided mode for insertion sheets.

SUMMARY OF THE INVENTION

The present invention was made for solving such problems, and an object of the invention is to provide an image forming apparatus and an image forming system that makes it possible to carry out image forming efficiently without a drop in productivity due to reading divided bundles, in executing image forming in a mixture of single-sided image forming and double-sided image forming.

Another object of the invention is to provide an image forming apparatus and an image forming system that offers high operationability for designation of image forming side/sides, in executing image forming in a mixture of single-sided image forming and double-sided image forming.

In a first aspect in accordance with the invention, an image forming system, comprising: a document conveying section that reversely conveys documents such that a front side and a back side of the documents pass through a reading position; an image reading section for reading images on the documents conveyed to the reading position and generating image data; an image forming section for forming images on recording media, according to the image data; an input section for inputting designation whether the images are to be formed on both sides or on one side of the recording media; and a control section for controlling image reading by the image reading section and image forming by the image forming section, wherein the control section controls the image forming section to form an image according to image data in a condition where a single job includes both single-sided image recording and double-sided image recording in a mixture, correspondingly to the designation inputted via the input section.

In a second aspect in accordance with the invention, an image forming system, comprising: an image reading section for reading images on documents and generating image data;

an image forming section for forming images according to the image data on recording media; a reverse conveying mechanism for reversely conveying the recording media to form the images on both sides of the recording media; a first input section for input of designation to set an inter-sheet mode for insertion of an insertion medium different from the recording media, wherein the insertion medium is inserted at least one of on a top of a bundle of image-formed recording media, at a bottom of the bundle of the recording media, and between the recording media; a second input section for input of designation whether images are to be formed on both sides of the insertion medium, an image is to be formed on one side of the insertion medium, or no image is to be formed on the insertion medium; a third input section for inputting designation whether images are to be formed on both sides or on one side of the recording media; and a control section for controlling not to reversely convey the insertion medium by the reverse conveying mechanism, if the designation of image forming on both sides of the recording media has been input via the third input section while the designation of image forming on one side of the insertion medium or the designation of forming no image on the insertion medium has been input via the second input section.

In a third aspect in accordance with the invention, an image forming system comprising: an image forming section for forming images on recording media selectively supplied from one of a plurality of trays; a first input section for input of designation to set an inter-sheet mode for inserting an insertion medium different from the recording media, wherein the insertion medium is inserted at least one of on a top of a bundle of image formed recording media, at a bottom of the bundle of the recording media, and between the recording media; a display section; and a control section for controlling image forming in the image forming section, wherein, the control section controls the display section to display a prompt for input of designation whether an image is to be formed on one side of the insertion medium or images are to be formed on both sides of the insertion medium, in response to the designation inputted to set the inter-sheet mode via the first input section.

BRIEF DESCRIPTION OF THE DRAWINGS

FIG. 7 is a diagram showing data structure in the first embodiment;

FIGS. 12(*a*) to 12(*c*) are diagrams showing screens in realizing the operation in the second embodiment;

DETAILED DESCRIPTION OF THE PREFERRED EMBODIMENTS

Figure 1:
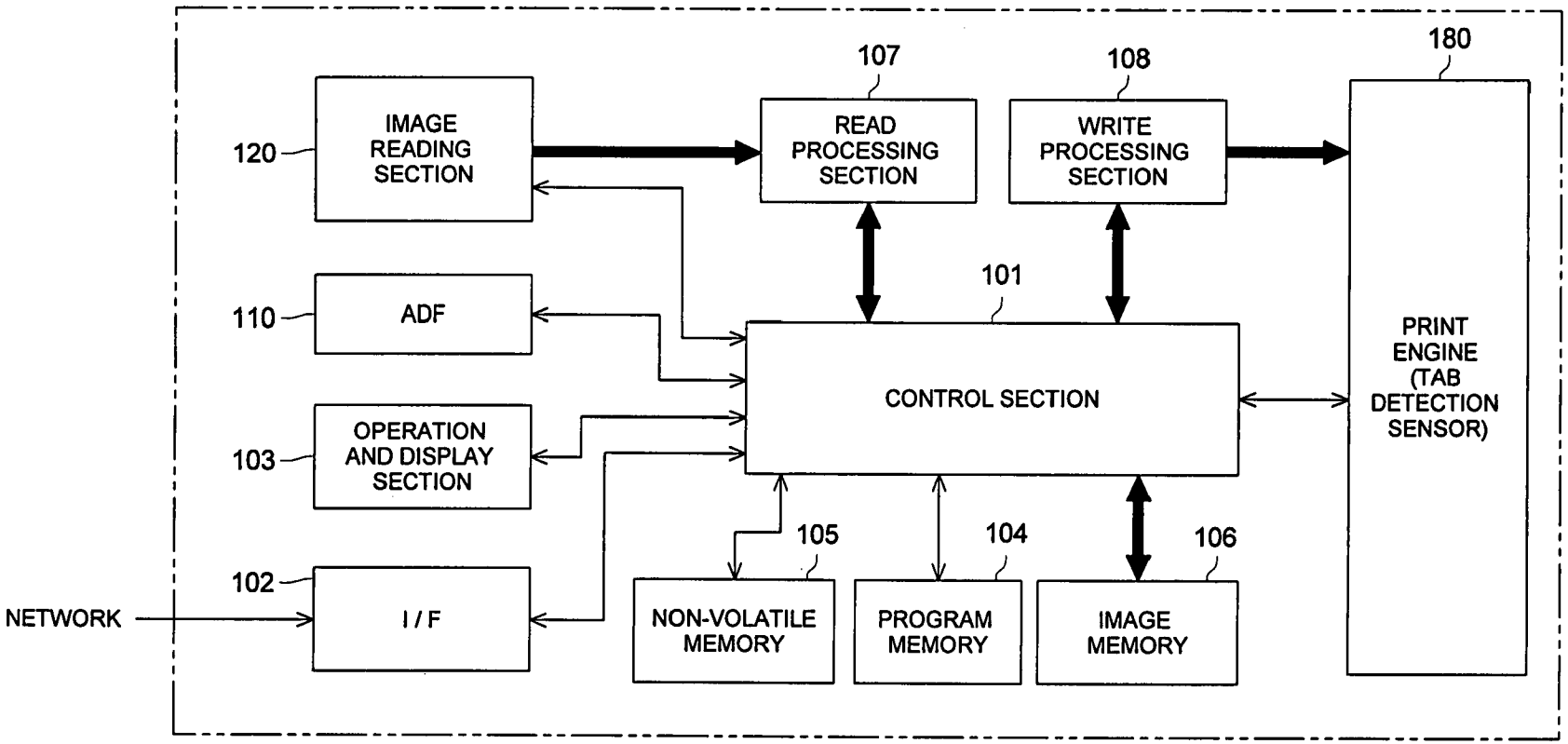
FIG. 1 is a function block diagram showing an electrical structure of an image forming apparatus in a first embodiment of the present invention.

The invention includes the following structures.

(1) An image forming system, including a document conveying section that reversely conveys a document such that a front side and a back side of the document pass through a reading position; an image reading section for reading an image on the document conveyed to the reading position and generating image data; an image forming section for forming an image on a recording medium, according to the image data; an input section for inputting designation whether to form an image on both sides or on one side of the recording medium; and a control section for controlling image reading by the image reading section and image forming by the image forming section, wherein the control section controls the image forming section to form an image according to image data, correspondingly to an input of designation via the input section in a condition where a single job includes both single-sided image recording and double-sided image recording in a mixture.

In this structure, in accordance with the designation via the input section, the image forming section is controlled so that image forming is carried out based on the image data obtained by reading documents in a state where both single-sided image forming and double-sided image forming are present in a mixture as a single job.

Therefore, when carrying out a mixture of single-sided image forming/double-sided image forming with medium feeding, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(2) The image forming system of item (1), wherein, correspondingly to an input of designation via the input section, the control section controls at least either the document conveying section or the image reading section to read an image on a document in a condition where a single job includes both single-sided image reading and double-sided image reading.

In this structure, in accordance with the designation via the input section, the image forming section is controlled so that image forming is carried out based on image data obtained by reading documents in a state where both single-sided image forming and double-sided image forming are present in a mixture as a single job, and in addition, in accordance with the designation via the input section, the image reading section is controlled so that document reading is carried out in a state where both single-sided document reading and double-sided document reading are present in a mixture as a single job.

As a consequence, in carrying out a mixture of single-sided document reading/double-sided document reading and a mixture of single-sided image forming/double-sided image forming, there is no need for operations and control as a programming job of handling the task as multiple jobs, and it is possible to carry out document reading and image forming as an integrated bundle. As a result, when carrying out a mixture of single-sided document reading/double-sided document reading and a mixture of single-sided image forming/double-sided image forming, it is possible to execute the job efficiently without a drop in the productivity due to, for example, reading separate bundles.

(3) The image forming system of item (2), wherein the control section controls to read one side of a document, the document corresponding to a page for which designation has been input via the input section to perform image recording on one side of a recording medium.

In this structure, for a document corresponding to a page designated, via the input section, for image forming to be carried out on one side of a recording medium, the image reading section is controlled to read only one side of the document corresponding to the one side, of the recording medium, on which image forming is to be carried out.

Thus, in a job in which double-sided reading and single-sided reading of the document are present in a mixture, it is possible to eliminate the tediousness of the user having to set the position of a document at which single-sided reading is to be made, eliminate the user having to mount documents several times to read the documents in plural times, thereby making it possible to carry out efficient image reading and image forming.

(4) The image forming system of item (1), including a plurality of trays for mounting a recording medium, wherein the control section selectively switches the plurality of trays, correspondingly to an input of designation via the input section, and the image forming section forms an image on a recording medium supplied from a tray to which the control section has switched.

In this structure, correspondingly to designation via the input section, the image forming section is controlled to perform medium feeding selectively from plural trays and perform image forming in a state where single-sided image forming and double-sided image forming are mixed.

In this structure, in accordance with designation via the input section, the image reading section is controlled to perform document reading in a state where both single-sided document reading and double-sided document reading are present as a single job, and further, in accordance with designation via the input section, the image forming section is controlled to perform medium feeding selectively from plural trays and to perform image forming based on the image data obtained by reading in a state where both single-sided document reading and double-sided document reading are present as a single job.

Therefore, at the time of carrying out a mixture of single-sided document reading/double-sided document reading and a mixture of single-side image forming/double-sided image forming accompanied by medium feeding from a plurality of trays, there is no need for operations and control as a programming job handling the task as multiple jobs, and it is possible to carry out document reading and image forming as an integrated bundle. As a result, when carrying out a mixture of single-sided document reading/double-sided document reading and a mixture of single-sided image forming/double-sided image forming, it is possible to execute the job efficiently without a drop in productivity due to, for example, reading separate bundles.

(5) The image forming system of item (1), including a display section, wherein the control section controls the display section to display a prompt for input of designation of single-sided image forming to be included in double-sided image forming and a prompt for input of designation of a tray for a recording medium for the single-sided image forming to be included in the double-sided image forming.

In this structure, in accordance with designation via the input section, in performing image forming based on image data obtained by reading in a state where both single-sided image forming and double-sided image forming are present as a single job, a display is made to prompt for input, via the input section, the selection of designation regarding single-sided image forming to be included in double-sided image forming, designation regarding the tray of a recording medium to be used for single-sided image forming included in double-sided image forming, and designation regarding single-sided document reading to be included in double-sided document reading.

(6) The image forming system of item (5), wherein, correspondingly to the input, the control section controls to perform the single-sided image reading included in the double-sided image reading, to supply the recording medium from the tray designated for the single-sided image forming included in the double-sided image recording, and to perform the single-sided image forming included in the double-sided image forming.

In this structure, in accordance with designation via the input section, the image forming section is controlled to perform image forming based on image data by reading in a state of a mixture of single-sided image forming and double-sided image forming as a single job, and further, when designation described in the above item (5) is made, the image forming section is controlled to perform single-sided image forming to be included in double-sided image forming, recording medium feeding from the designated tray of a recording medium to be used for single-sided image forming included in double-sided image forming, and single-sided document reading to be included in double-sided document reading.

Therefore, at the time of carrying out a mixture of single-sided document reading/double-sided document reading and a mixture of single-side image forming/double-sided image forming accompanied by medium feeding from a plurality of trays, there is no need for operations and control as a programming job handling the task as multiple jobs, and it is possible to carry out document reading and image forming as an integrated bundle. As a result, when carrying out a mixture of single-sided document reading/double-sided document reading and a mixture of single-sided image forming/double-sided image forming, it is possible to execute the job efficiently without a drop in productivity due to, for example, reading separate bundles.

(7) An image forming system, including an image reading section for reading an image on a document and generating image data; an image forming section for forming an image according to the image data on a recording medium; a reverse conveying mechanism for reverse conveying the recording medium to form an image on both sides of the recording medium; a first input section for input of designation to set an inter-sheet mode for insertion of an insertion medium different from the recording medium, wherein the insertion medium is inserted on a top of a bundle of image-formed recording mediums, at a bottom of the bundle of the recording mediums, or between the recording mediums; a second input section for input of designation whether to form an image on both sides of the insertion medium, to form an image on one side of the insertion medium, or to form no image on the insertion medium; a third input section for inputting designation whether to form an image on both sides or on one side of the recording mediums; and a control section for controlling not to reversely convey the insertion medium by the reverse conveying mechanism if setting of image forming on both sides of the recording mediums has been input via the third input section while setting of image forming on one side of the insertion medium or setting of forming no image on the insertion medium has been input via the second input section.

In this structure, when setting of image forming on both sides of a recording medium has been made via the third input section, and the setting of image forming on a single side of an insertion medium or setting of forming no image has been made via the second input section, the image forming is executed by controlling such that the inserted medium is not reversely conveyed by the reverse conveying section.

Therefore, when carrying out a mixture of a mixture of single-sided image forming/double-sided image forming with medium feeding, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(8) The image forming system of item (7), wherein the designation via the third input section can be input for each page.

In this structure, when setting of image forming on both sides of a recording medium has been made via the third input section, and the setting of image forming on a single side of an insertion medium or setting of forming no image has been made via the second input section, the image forming is executed by controlling such that the inserted medium is not reversely conveyed by the reverse conveying section, wherein designation via the second input section can be input for each page.

In this case, when carrying out a mixture of single-sided image forming and double-sided image forming that can be set for each page, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(9) The image forming system of item (7), wherein the second input section receives input of designation whether to form an image on one side of an insertion medium or to form no image on the insertion medium, according to a type of the insertion recording medium.

In this case, when carrying out a mixture of single-sided image forming according to the type of insertion medium and double-sided image forming, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(10) The image forming system of item (9), wherein the type of the insertion medium includes at least one of preprinted medium, paperboard, and tab paper.

In this structure, when setting of image forming on both sides of a recording medium has been made via the third input section, and the setting of image forming on a single side of an insertion medium or setting of forming no image has been made via the second input section, the image forming is executed by controlling such that the inserted medium is not reversely conveyed by the reverse conveying section, wherein designation is input via the second input section for setting image forming on a single side of an insertion medium or setting of forming no image, according to the type (at least one of a pre-printed medium, paper board, or tab sheet) of the insertion medium.

In this case, when carrying out a mixture of single-sided image forming according to various types of insertion medium and double-sided image forming, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(11) The image forming system of item (7), including a document conveying section having a function to reversely conveying a document so that a front side and a back side of the document passes through a reading position, wherein the control section determines whether or not to reversely convey a document correspondent to the insertion medium, according to the input via the second input section.

In this structure, if setting of image forming on both sides of a recording medium has been made via the third input section, and setting of image forming on a single side of an insertion medium or setting of forming no image has been made via the second input section, then the image forming is executed by controlling such that the inserted medium is not reversely conveyed by the reverse conveying section, wherein, in accordance with input via the second input section, it is determined whether or not to carry out reverse conveying of the document corresponding to the insertion medium.

In this case, when setting of carrying out image forming on one side of the insertion medium or setting of forming no image has been made, and a mixture of single-sided image forming and double-sided image forming is performed, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(12) The image forming system of item (11), wherein the control section controls to perform single-sided reading in reading a document correspondent to an insertion sheet if single-sided image forming has been set for the insertion sheet via the second input section.

In this structure, if setting of image forming on both sides of a recording medium has been made via the third input section, and the setting of image forming on a single side of an insertion medium or setting of forming no image has been made via the second input section, then the image forming is executed by controlling such that the inserted medium is not reversely conveyed by the reverse conveying section, wherein, in accordance with input via the second input section, it is determined whether or not to carry out reverse conveying of the document corresponding to the insertion medium, and wherein if single-side setting has been made for the insertion medium, document reading corresponding the insertion medium is also controlled to be single-sided reading.

In this case, when setting of carrying out image forming on one side of an insertion medium has been made and a mixture of single-sided image forming and double-sided image forming is performed, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

(13) An image forming system including an image forming section for forming an image on a recording medium selectively supplied from one of a plurality of trays; a first input section for input of designation to set an inter-sheet mode for inserting an insertion medium different from the recording medium, wherein the insertion medium is inserted on a top of a bundle of image formed recording mediums, at a bottom of the bundle of the recording mediums, or between the recording mediums; a display section; and a control section for controlling image forming in the image forming section, wherein, the control section controls the display section to display a prompt for input of designation whether to form an image on one side of the insertion medium or to form an image on both sides of the insertion medium, in response to an input of designation to set an inter-sheet mode via the first input section.

In this structure, a display is made to prompt input, via the second input section, of selection of designation of single-sided/double-sided image forming on an insertion medium inserted during image forming on recording mediums in the inter-sheet mode, and according to designation made via the second input section, the image forming section is controlled so that image forming on the recording mediums and the image forming on the insertion medium are carried out as a single job.

Therefore, since the selection regarding designation of single-sided/double-sided image forming on an insertion medium in the inter-sheet mode is input, and image forming on recording mediums and image forming on a insertion medium are executed as a single job, operationability for designation of image forming side is improved.

In addition, in the inter-sheet mode, it is possible to prevent forgetting to input designation of single-sided or double-sided image forming on an insertion medium. Therefore, for example, even when using a medium that is likely to cause jamming at the time of reverse conveying as an insertion medium, it is possible to prevent forgetting to input designation of single-sided image forming, having a good-effect on suppressing jamming.

Therefore, as the selection of designation regarding single-sided image forming or double-sided image forming on an inserted medium in the inter-sheet mode is input, and also image forming on recording mediums and image forming on an insertion medium are executed as a single job, the operationability for designation of image forming side is improved.

(14) The image forming system of item (13), including a second input section for input of designation whether to form an image on one side or on both sides of the insertion medium, wherein the control section controls the image forming section to form an image on the insertion medium, correspondingly to an input via the second input section.

In this structure, a display is made to prompt for input of selection of designation of single-sided image forming, double-sided image forming, or forming no image on an insertion medium inserted during image forming on recording mediums, and if a selection of designation is input, the image forming section is controlled to perform image forming on recording mediums and an insertion medium as a single job, wherein image forming on the insertion medium is performed in accordance with the designation whether to perform single-sided image forming, double-sided image forming, or forming no image.

Therefore, since input is a selection of designation regarding single-sided image forming, double-sided image forming on the insertion medium, or forming no image on an insertion medium during the inter-sheet mode, and performed are image forming on recording mediums and image forming on the insertion medium as a single job, operationability for designation of image forming side is improved.

(15) The image forming system of item (14), including a third input section for inputting designation whether to form an image on one side or on both sides of the insertion medium, wherein the control section controls the image forming section to form an image on the recording mediums and to form an image on the insertion medium, correspondingly to an input of designation via the third input section and to an input of designation via the second input section.

In this structure, if input is a selection of designation whether to perform single-sided image forming, double-sided image forming, or forming no image on an insertion medium to be inserted during image forming on recording mediums, then the image forming section is controlled to perform image forming on recording mediums and an insertion medium as a single job, wherein image forming on the insertion medium is performed according to the selection of designation whether to perform single-sided image forming, double-sided image forming, or forming no image on the insertion medium, and image forming on the recording mediums is performed on the recording mediums, according to the selection of designation whether to perform single-sided image forming or double-sided image forming.

(16) The image forming system of item (15), wherein the control section controls the image forming section to perform image forming on the recording mediums and the insertion medium as a single job, correspondingly to an input of designation via the first input section, an input of designation via the second input section, and an input of designation via the third input section.

(17) The image forming system of item (13), including a tab detecting section for detecting a tab of an insertion medium, wherein the control device controls the image forming section to make image forming on the insertion medium to be image forming on one side, correspondingly to a detection result by the tab detecting section.

In this structure, a display is made to prompt input of selection of designation of single-sided or double-sided image forming on an insertion medium inserted during image forming on recording mediums, and when a selection of designation is input, the image forming section is controlled to perform image forming on the recording mediums and image forming on the insertion medium as a single job, wherein the image forming section is controlled, in accordance with the result of detection by the tab detection section, so that single-sided image forming is carried out on the insertion sheet.

In this structure, in the inter-sheet mode, a display is made to prompt input of selection of designation regarding single-sided or double-sided image forming on an insertion medium inserted during image forming on recording mediums, and when a selection of the designation is input in response to this display, the image forming section is controlled so as to carry out image forming on the recording sheets and image forming on the inserted medium as a single job, wherein, according to the result of tab detection for the inserted medium, the image forming section is controlled so that image forming is made on a single side of the inserted medium.

Therefore, since input is a selection of designation regarding single-sided image forming or double-sided image forming on an insertion medium in the inter-sheet mode, and performed are image forming on recording mediums and image forming on the insertion medium as a single job, and in addition, since performed is appropriate control to perform single-sided image forming even when the insertion medium is a tab sheet, operationability for designation of image forming side is improved.

In the following, preferred embodiments (hereinafter referred to as embodiments) of the present invention will be described, referring to the drawings.

First Embodiment

In a first embodiment of the present invention, the basic structure is an image forming apparatus (copying apparatus) provided with a function to read the content of an object of copying (a document) as image information using a document reading unit (a scanner) and copying it. However, embodiments of the present invention can be applied even in the case of an image forming system constructed by a scanner, a computer, and a printer.

Further, in the first embodiment, the description is given, taking an example of an image reading device having the function of generating image data by reading an image while conveying the document, that is, an image reading device or an image forming apparatus that has an image reading device such as a solid image pick-up device of a plural pixels along the main scanning direction and carries out two-dimensional reading (sheet through type reading) in the main scanning direction and the sub scanning direction by moving the document along the sub scanning direction with respect to the image reading device.

Mechanical Structure of Image Forming Apparatus

Figure 2:
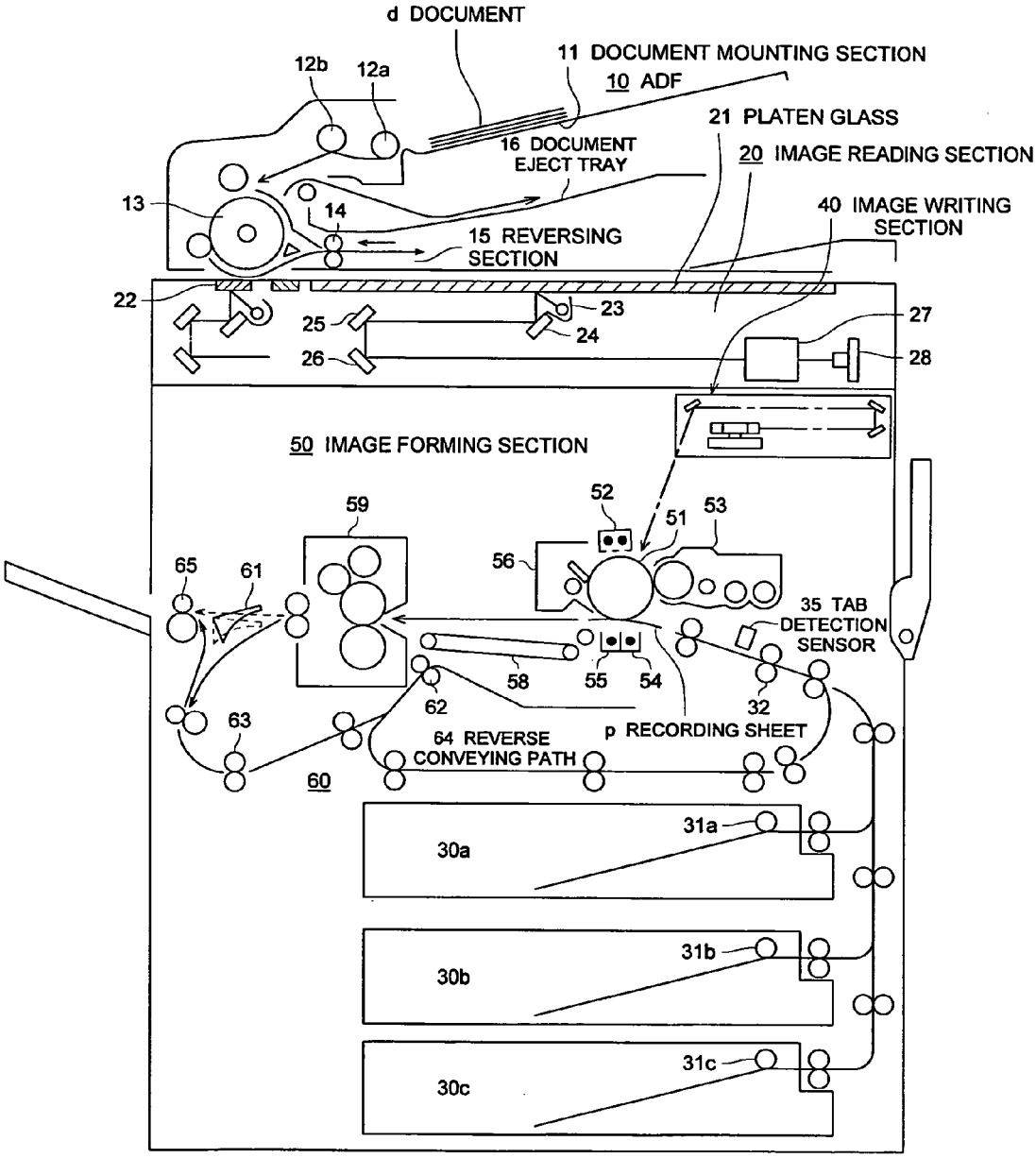
FIG. 2 is a structural diagram showing a mechanical structure of the image forming apparatus in the first embodiment.

First, the mechanical structure of an image forming apparatus is described here, referring to FIG. 2. Here, a copying machine that reads the image of a document and forms a corresponding image is taken as an example in this embodiment.

In FIG. 2, reference number 10 denotes a document conveying section (hereinafter referred to as a document conveying section or ADF) which is a unit for feeding a document for reading one side or both sides of the document while conveying the document. Reference number 20 denotes an image reading section (scanner) that reads by scanning the document optically and generates image data. Also, reference number 40 is an image writing section that generates a light beam for exposure according to the image data, and reference number 50 is an image forming section that records on a recording medium p (also called transfer paper or a recording sheet, and is hereinafter referred to as recording sheet in this specification) image data in an electrostatic method. Further, reference number 60 is a conveying section that carries out transportation of recording sheets.

Further, a plurality of sheets of document d is mounted on a document mounting section 11 of ADF 10 that is capable of double-sided feeding of documents in a condition where the front side of the first page of the documents is facing upward. The first sheet of the documents fed via a roller 12*a* and a roller 12*b* is rotated by a roller 13.

At this time, the document surface of the document d is illuminated by a light source 23, and the reflected light from it passes through mirrors 24, 25, 26, and an imaging optical system 27, and forms an image on the light receiving surface of a CCD (reading device) 28 which is a photoelectric conversion unit. Here, the image reading section 20 is constructed by an optical system having the light source 23, the mirrors 24, 25, 26, the imaging optical system 27, the CCD 28, and also an optical system driving unit not shown in the figure. The light source 23 is a light source constructed by a rod-shaped Xenon lamp having its longitude side along the main scanning direction.

In FIG. 2, in the case where the document d is mounted above a platen glass 21 with the read side of the document facing downward, the optical system reads the image of the document while scanning along the platen glass 21.

Further, in the case where the document d is fed automatically by the ADF 10 and turns around the roller 13, the reading is done in a state where the light source 23 and the mirror 24 have moved below the slit glass 22 and are fixed. Then, the image data of the document d that has been read is sent from the CCD 28 to a read image processing section, not shown in the figure.

Further, when the document d is fed and conveyed automatically by the ADF 10, once the first page of the document d is read, the document d is wound using the roller 13 again via reversing rollers 14, the image on the back side of the document d is read by the image reading section 20, and sent to a read image processing section.

In this manner, the document d whose front side and back side have been read out is reversed again by the reversing roller 14, and the document is placed on a document eject tray 16 with the front side of the document facing downward.

The image data read out in this manner in the image reading section 20 is first subjected to specific image processing operations in the read processing section, compressed by a compression and expansion circuit, and is then stored in an image memory.

On the other hand, a recording sheet p is taken out from one of sheet feeding trays 30*a* to 30*c* stacked with recording sheets p via the first sheet feeding rollers 31*a* to 31*c*, and is conveyed to the image forming section 50.

The recording paper p fed to the image forming section 50 is synchronized by the second sheet feeding roller (the registration roller) 32 near the entrance, and comes close to a photosensitive drum 51 which is the image carrier. Further, a tab detecting sensor 35 is provided as a tab detection section in the vicinity of the second sheet feeding roller 32 and detects whether it is a normal recording sheet or a tab sheet used as an insertion sheet, and if it is a tab sheet, also detects the tab position and tab size, etc.

Next, the image data is input from a write processing section to an image writing section 40, a laser beam corresponding to image data from a laser diode inside the image writing section 40 is projected onto a photosensitive drum 51, thereby forming an electrostatic latent image. By developing this electrostatic latent image in a developing section 53, a toner image is formed on the photosensitive drum 51.

This toner image is transferred onto the recording sheet p by the transfer section 54 located below the photosensitive drum 51. Next, the recording sheet p in pressure contact with the photosensitive drum 51 is separated by a separating section 55. The recording sheet p separated from the photosensitive drum 51 enters a fixing section 59 via a conveying mechanism 58 and the toner image is fixed by heat and pressure. In this manner, an image is formed on the recording sheet p.

Further, as necessary, the recording sheet p on which the toner image has been fixed is conveyed downwards via a guide 61 and enters a reversing section 63. Next, the recording sheet p that has entered the reversing section 63 is taken out again by a reversing roller 62, and is conveyed again to the image forming section 50 via a reverse conveying path 64. After the image forming on one side of the document d is completed in the image forming section 50, the toner adhered to the photosensitive drum 51 is removed by a cleaning section 56, and then the photosensitive drum 51 is charged by a charging section 52, thereby preparing for the next image forming.

In this condition, the other side of the recording sheet p (the side on which image forming has not yet been done) is conveyed into the image forming section 50 and an image is formed on this side. The recording sheet p separated from the photosensitive drum 51 by the separating section 55 enters again the fixing section 59 via the conveying mechanism 58 and toner is fixed there. In this manner, the recording sheet p having image forming completed on its front side and back side, or having image forming completed on one side is then ejected.

Electrical Structure of the Image Forming Apparatus

FIG. 1 is a block diagram showing the detailed structure in an image forming apparatus 100, according to the first embodiment of the invention. Further, in FIG. 1, the description has been made mainly on the parts necessary for explaining the operation of the present embodiment and description of all other known parts of an image forming apparatus have been omitted.

Herein, the image forming apparatus 100 has a function to output by forming an image in response to image data obtained from a computer via a network 1 or image data generated by reading, using a built-in scanner (image reading section described above).

Further, here the image forming apparatus 100 has a function to reversely convey the document so that the front side and the back side of the document pass through the reading position. Further, this image forming apparatus 100 has a function to emit a reading light on to a conveyed document, receiving the reflected light from the document, and generate image data by thus reading the image. Further, this image forming apparatus 100 has a function to selectively feed a recording sheet from one of a plurality of trays, and form images corresponding to the image data on both sides of the recording sheet.

Further, in this image forming apparatus 100, reference number 101 is a control section that controls respective sections as a control means. Further, the control section 101 has a function to receive designation of a tray of insertion sheets different from the recording sheets used for normal image forming and the page position of insertion of an insertion sheet, as an inter-sheet mode.

Further, this control section 101 controls a print engine so as to carry out image forming based on image data obtained by reading, in accordance with the designation made via the operation and display section, in a condition where single-sided image forming and double-sided image forming are present in a mixture in a single job.

Further, this control section 101 controls the print engine so as to carry out image forming based on image data obtained by reading, in accordance with designation made via the operation and display section, in a condition in which single-sided image forming and double-sided image forming are present in a mixture in a single job. Further, the control section 101 controls the image reading section so as to carry out document reading, in accordance with designation made via the operation and display section, in a condition in which single-sided document reading and double-sided document reading are present in a mixture in a single job.

Still further, this control section 101 controls the print engine so as to carry out image forming based on image data obtained by reading, in accordance with designation made via the operation and display section, in a condition in which single-sided image forming and double-sided image forming are present in a mixture in a single job, and further, controls the print engine so as to carry out image forming based on the image data obtained by reading, in accordance with designation made via the operation and display section, while switching the sheet feeding selectively from a plurality of trays in a single job.

Yet further, this control section 101 controls the print engine so as to carry out image forming for the image data obtained by reading, in accordance with designation made via the operation and display section, in a condition in which single-sided image forming and double-sided image forming are present in a mixture in a single job, and further, controls the image reading section so as to carry out document reading, in accordance with designation made via the operation and display section, in a condition in which single-sided document reading and double-sided document reading are present in a mixture in a single job. In addition, the control section 101 controls the print engine so as to carry out image forming based on the image data obtained by reading, in accordance with designation made via the operation and display section, while switching the sheet feeding selectively from a plurality of trays in a single job.

Further, this control section 101 controls the print engine so as to carry out image forming for the image data obtained by reading, in accordance with designation made via the operation and display section, in a condition in which single-sided image forming and double-sided image forming are present in a mixture in a single job. Further, the control section 101 carries out control so as to carry out display prompting input, via the operation and display section, of designation of single-sided image forming to be included in double-sided image forming, designation of the tray of a recording sheet when performing single-sided image forming to be included in double-sided image forming, and designation regarding single-sided document reading to be included in double-sided document reading. When these designations are input, the control section 101 controls to carry out single-sided image forming to be included in double-sided image forming, sheet feeding from the designated tray of recording sheet during single-sided image forming included in double-sided image forming, and single-sided document reading to be included in double-sided document reading.

Further, when controlling image reading and image forming and the inter-sheet mode is designated, and also, when double-sided image forming is not possible for the insertion sheet set in the tray designated as the tray for the insertion sheet, the control section 101 has the following functions.

To control to perform single-sided reading of the page of a document corresponding to an insertion sheet, and to perform double-sided reading of all other document pages.

According to the image data obtained by reading, to control to feed a sheet from a tray for insertion sheets for the page corresponding to the insertion sheet, perform single-sided image forming, and eject it without conveying it to the reverse conveying path, and to perform double-sided image forming on recording sheets for other pages.

In addition, if the insertion sheet in the designated inter-sheet mode is a tab sheet, this control section 101 has a function to extend the reading area for the tab part of the tab sheet.

Further, the control section 101 can also judge whether or not it is possible to carry out double-sided image forming on the inserted sheet, according to the designation, by the user, of image forming side (designation of double-sided or single-sided) for the insertion sheet, or designation of a blank sheet insertion, that is, designation of no image forming, or according to the type of media of the insertion sheet. When making the judgment based on the type of medium of the insertion sheet, although the judgment can be made based on the type of media of the insertion sheet input by the user, it is also possible to make the judgment as follows. The correspondences between trays in which insertion sheets are stored and the types of media are stored in advance, and upon selection of a tray storing insertion sheets to be used, the type of the corresponding stored medium is read. If the type of the medium of the insertion sheet is any one of—tab sheet, pre-printed paper (a sheet on which back side an image has already been formed), and paper board, the control section 101 preferably judges that double-sided image forming is not possible.

Further, in this figure, an interface (I/F) 102 is a communication means that carries out communication via a network 1, and an operation and display section 103 is used to input various operations of the apparatus and to make various types of displays. Further, this operation and display section 103 or the interface (I/F) 102 constructs the aforementioned respective input sections.

Examples of inputting various types of designation via the operation and display section 103 are described in the following paragraphs.

The operation and display section 103 has a function to receive, along with designation of the inter-sheet mode, designation of a tray of an insertion sheet that is different from recording sheets used for normal image forming, and to receive designation of the insertion page position of the insertion sheet. Further, it is also possible that the insertion sheet is inserted not only between recording sheets but also as the front cover sheet before the first page of recording sheets or as the back cover sheet after the last page of the recording sheets.

Further, the operation and display section 103 has a function to receive designation of carrying out image forming based on image data obtained by reading in a state where single-sided image forming and double-sided image forming are present in a mixture in a single job. Further, the operation and display section 103 has a function to switch sheet feeding selectively from a plurality of trays in a single job, and receive designation of performing image forming based on image data obtained by reading. In addition, the operation and display section 103 has a function to perform a display of prompting input, via the operation and display section, of a selection of designation of single-sided image forming to be included in double-sided image forming, or designation of the tray of recording sheets for single-sided image forming included in double-sided image forming, or designation regarding single-sided document reading to be included in double-sided document reading. The operation and display section 103 also receives these designations.

Further, when the image forming apparatus is used as a copying machine, this operation and display section 103 receives inputs via the operation panel, and when the image forming apparatus is used as a printer via a network, the interface (I/F) 102 receives inputs of designations from a host computer via the network.

Further, a program memory 104 storing control programs is used when the control section 101 controls the image forming apparatus 100, and a non-volatile memory 105 is used as a table for storing and accumulating various types of data and set values of the image forming apparatus 100.

An image memory 106 stores image data expanded at the time of image forming or compressed image data of jobs. In addition, this image memory 106 is configured, as necessary, using semiconductor memories or hard disk drives, etc.

Furthermore, a read processing section 107 carries out image processing (read image processing) during image reading, and a write processing section 108 carries out image processing (write image processing) during image forming.

Further, an ADF 110 functions as a document conveying section, corresponding to the ADF 10 in the mechanical structure shown in FIG. 2, and is a unit for carrying out document feeding for reading one side or both sides of a document while conveying the document. In other words, this ADF 110 is a document conveying section having a function to reversely convey the document so that the front side and the back side of the document pass through the reading position.

An image reading section 120 (scanner) reads the document by optically scanning it and generates image data, corresponding to the image reading section 20 in the mechanical structure shown in FIG. 2, and has a function to read in sheet-through type. In other words, this image reading section 120 is an image reading unit having a function to emit reading light onto a conveyed document and read the image by receiving reflected light from the document to generates image data.

Further, a print engine 180 functions as a printing unit that receives image data from a write processing section 108 and outputs it forming an image on a recording sheet, and includes, in the mechanical structure of FIG. 2, the tab detection sensor 35, the image writing section 40, the image forming section 50, the conveying section 60, etc. Also, a print engine 180 has a function to selectively feed a recording sheet stored in a plurality of trays and form images according to image data on both sides of the recording sheet.

Further, the image forming apparatus 100 connected to the network 1 can be not only a copying machine but also a various type of devices such as a facsimile device, a printer, or a digital multifunction device, etc. In addition, the print engine 180 can also be an electrophotographic type using a photosensitive body and a laser beam as well as one that uses an LED print head or an ink jet type.

Operation in the First Embodiment

The operation of the image forming apparatus according to the first preferred embodiment of the present invention, that is, the procedure of controlling the image forming apparatus, is explained in detail in the following, referring to a flowchart in FIG. 3 and the operation inputs made by the operator via the operation and display section 103 shown in FIG. 4.

Further, FIGS. 4A to 4C are examples of basic screens displayed in the operation and display section 103 based on the control by the control section 101. Herein, FIG. 4A shows a basic screen for carrying out various types of basic settings, FIG. 4B shows an application functions settings screen in which application functions are selected, and FIG. 4C is an explanatory diagram showing an inter-sheet mode setting screen for designation of the tray of an insertion sheet and the insertion page position of the insertion sheet, in an application function referred to as the inter-sheet mode (function to insert an insertion sheet between recording sheets).

First, the basic screen (FIG. 4A) is displayed in the operation and display section 103 under the control of the control section 101, and the designation input from the operator is prompted.

Figure 3:
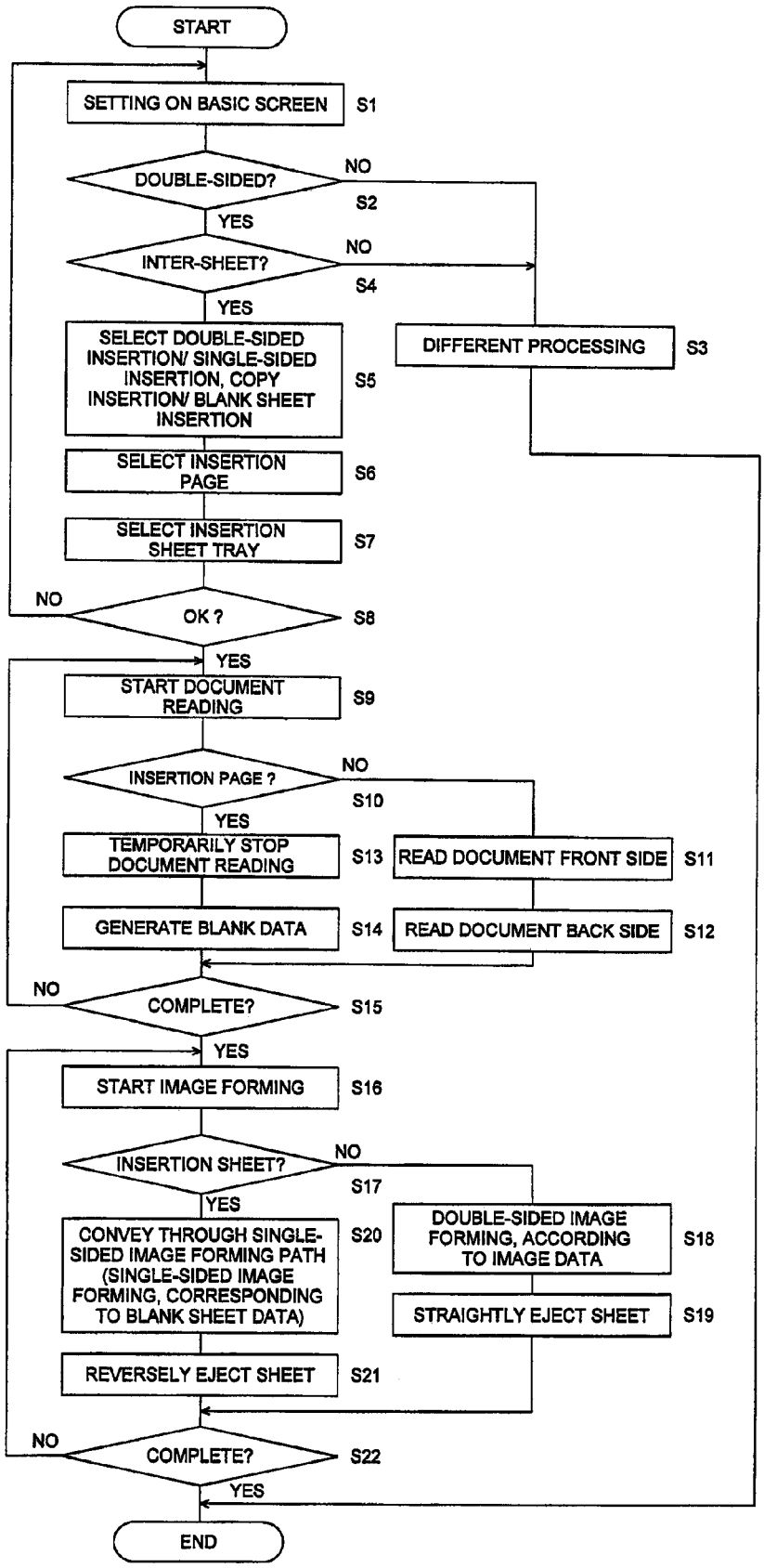
FIG. 3 is a flow chart showing operation in the first embodiment.
Figure 4:
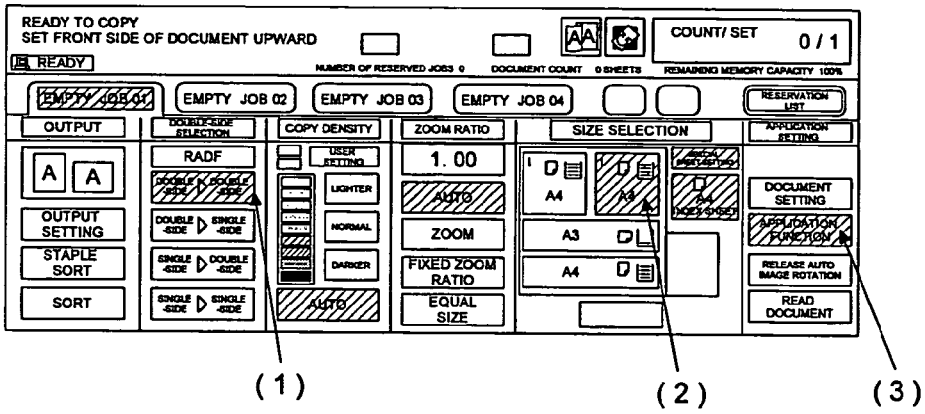
FIG. 4 is a diagram showing screens in realizing the operation in the first embodiment.
Figure 4:
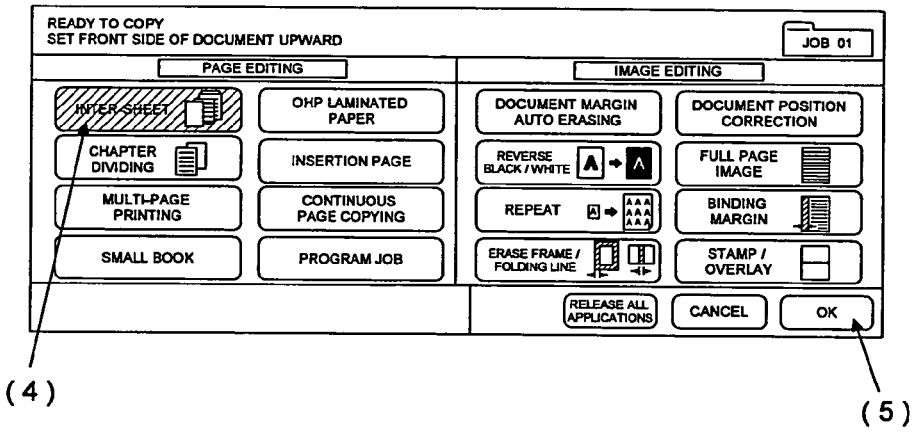
Figure 4:
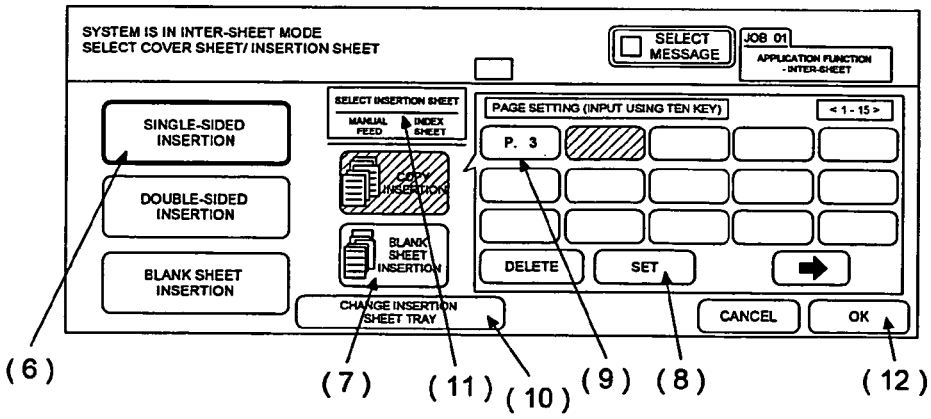

In setting on the basic screen in FIG. 4A, the setting of double-sided copying of a double-sided document is made by the operator (FIG. 4A (1)), and it is assumed that the recording sheets of A4 size in tray #2 have been selected by the operator (FIG. 4A (2)) (FIG. 3 S1).

In this case, if the document is not double-sided (NO in FIG. 3 S2), as it is either single-sided reading or single-sided image forming, the control section 101 executes a different process such as the single-sided processing (FIG. 3 S3). Detailed description in this embodiment is omitted for the single-sided image document reading process and the single-sided image forming process.

Then, in setting on this basic screen, it is assumed that the selection of the application function (FIG. 4A (3)) has been made by the operator.

When an application function is not selected (NO in FIG. 3 S4), the control section 101 executes a different process such as the normal process (FIG. 3 S3). Further, detailed description is omitted for the normal process in the present embodiment.

When the operator selects an application function on the basic screen (FIG. 4A (3)), the control section 101 displays an application function setting screen, shown in FIG. 4B, of the operation and display section 103. In other words, the application function setting screen (FIG. 4B) is displayed on the operation and display section 103 under the control of the control section 101, and input of designation from the operator is prompted.

Such application functions available are—inter-sheet mode, chapter division, black-white reversal, repeat, frame/folding line erasure, full page image, binding margin, stamp/overlay, etc. In the first embodiment, it is assumed that the operator selects the inter-sheet mode (FIG. 4B (4)) and presses the "OK" button (FIG. 4B (5), YES in FIG. 3 S4).

Further, when an application function other than the inter-sheet mode is selected (NO in FIG. 3 S4), the control section 101 executes a different process corresponding to the respective selected application function (FIG. 3 S3). Further, detailed description of other application functions in this embodiment is omitted.

When the inter-sheet mode is selected by the operator (FIG. 4B (4) (5)) on the application function setting screen, the control section 101 displays, on the operation and display section 103, the insertion mode setting screen shown in FIG. 4C. In other words, the insertion mode setting screen (FIG. 4C) is displayed by the control section 101 on the operation and display section 103, and the input of designation by the operator is prompted.

The selections and designations in this insertion mode can be—selection of single-sided insertion or double-sided insertion, selection of copy insertion or blank sheet insertion, designation of the tray of insertion sheet different from the recording sheets used for normal image forming, designation of the insertion page position of the insertion sheet, etc.

In the first embodiment, if the selection of single-sided insertion (FIG. 4C (6)) or blank sheet insertion (FIG. 4C (7)) is made by the operator (FIG. 3 S5), and if the setting of an insertion-page is selected (FIG. 4C (8)), the control section 101 receives input from the ten-keys of the page number at which the insertion page is to be inserted.

Herein, it is assumed that the third page is selected as the position of the insertion sheet (FIG. 4C (9)) by the operator (FIG. 3 S6).

Further, in the first embodiment, if it is assumed that a change of the tray of insertion sheet has been selected (FIG. 4C (10)), the control section 101 displays the tray selection screen (not shown in the figure) on the operation and display section 103, and accepts a change in the tray of insertion sheet. Herein, it is assumed that a manual sheet feed tray in which tab sheets (index sheets) are mounted is selected as the tray of the insertion sheet (FIG. 4C (11)) (FIG. 3 S7). In other words, when the tray having tab sheets is selected as the tray of the insertion sheet, a tab sheet will be inserted as the insertion sheet at the designated page position.

Here, when the settings are completed on the above application function setting screen, insertion mode setting screen, or inter-sheet mode setting screen, the operator selects "OK" (FIG. 4C (12)) (YES FIG. 3 S8), whereby the setting is completed for obtaining image forming output matter of a mixture of single-sided and double-sided image forming including single-sided image forming on insertion sheets. Thereafter, the control section 101 retains the settings or selections input via the operation and display section 103 in the non-volatile memory 105.

Figure 5:
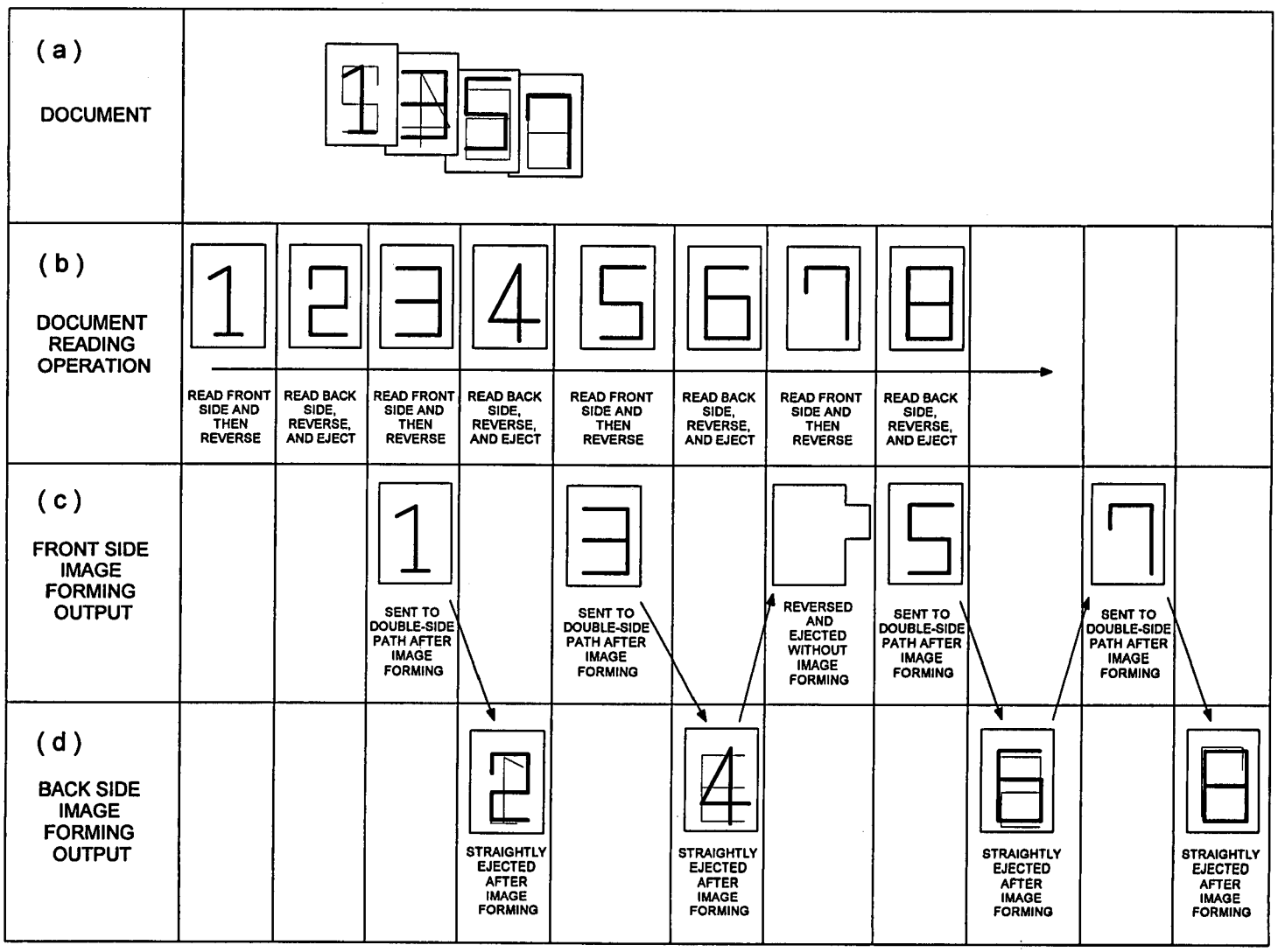
FIG. 5 is a time chart in realizing the operation in the first embodiment.

Next, the control section 101, based on the above settings, gives instructions to the ADF 110 and the image reading section 120, and starts image reading (FIG. 3 S9). Herein, it is assumed that that the documents to be read are, as shown in FIG. 5 (*a*), in the sequence of double-sided document #1 (Page 1-Page 2), double-sided document #2 (Page 3-Page 4), double-sided document #3 (Page 5-Page 6), and double-sided document #4 (Page 7-Page-8).

Herein, the control section 101 refers to the settings input by the operator in each of the screens described above (basic screen, application function setting screen, and inter-sheet mode setting screen), and judges whether the document to be read corresponds to an insertion sheet (blank sheet insertion page) (FIG. 3 S10). Further, depending on whether it is generation of image data by reading a normal document page or generation of a blank sheet image data for the insertion sheet (blank sheet insertion page) as described below, the reading continues until all documents are read in (FIG. 3 S15).

If a document to be read does not correspond to an insertion sheet (blank sheet insertion page) in the image forming output (NO in FIG. 3 S10), under the control of the control section 101, the front side of the document is read (FIG. 3 S11) by the image reading section 120 while the document is being conveyed by ADF 110, and then the document is reversed by the ADF 110. Subsequently, while conveying the same document by the ADF 110, its back side is read (FIG. 3 S12), the document is reversed and then ejected. Herein, the front side and the back side of each of two documents, that is, double-sided document #1 and double-sided document #2 are read in this manner and image data is generated (see FIG. 5 (*b*)). The image data obtained by reading in this manner is stored by the control section 101 in the image memory 106.

Thereafter, since the next third sheet corresponds to an insertion sheet (blank sheet insertion page) in the image forming output (YES in FIG. 3 S10), the control section 101 temporarily stops reading a document (FIG. 3 S13). Then, the control section 101 generates a blank image data (FIG. 3 S14) as the image data corresponding to the insertion sheet (blank sheet insertion page).

Thereafter, since the double-sided document #3 and double-sided document #4 do not correspond to an insertion sheet (blank sheet insertion page) (NO in FIG. 3 S10), under the control of the control section 101, the front side of the document is read (FIG. 3 S11) by the image reading section 120 while the document is being conveyed by the ADF 110, and then the document is reversed by the ADF 110. Subsequently, while conveying the same document by the ADF 110, its back side is read (FIG. 3 S12), the document is reversed and then ejected (see FIG. 5 (*b*)).

Further, the image data obtained by the reading operation is first subjected to image processing during reading by the read image processing section 107, and is stored in units of a job in the image memory 106 based on an instruction from the control section 101.

In the above reading operations, in the case of including an insertion sheet in the image forming output during the inter-sheet mode, for documents in which there is no blank sheet corresponding to the insertion sheet, it is possible to read efficiently in one reading without using a dedicated sensor or without a drop in productivity due to reading separate bundles.

Further, when the above image reading is completed, the control section 101 gives instructions to the write image processing section 108 and the print engine 180 and starts the image forming (FIG. 3 S16). However, even if the reading of all documents has not been completed, it is possible to start the image forming at the point of time when the reading of at least the first double-sided document #1 has been completed.

Herein, the image forming is carried out in accordance with image data obtained by reading the document shown in FIG. 5 (*a*) (double-sided document #1 (Page 1-Page 2), double-sided document #2 (Page 3-Page 4), double-sided document #3 (Page 5-Page 6), and double-sided document #4 (Page 7-Page 8)), and the settings input from the operation and display section 103 (herein, in addition to the double-sided copying of the documents, insertion of an insertion sheet as the blank sheet insertion page at the third sheet of the document).

Further, the control section 101 refers to the input of the settings made by the operator in each of the above screens (basic screen, application function settings screen, and inter-sheet mode setting screen), and makes the judgment as to whether it is a normal recording sheet or an insertion sheet (FIG. 3 S17).

Further, the control section 101 continues as follows different image forming depending on whether it is an ordinary recording sheet or an insertion sheet for all the sheets until the image forming of all the image data of the corresponding job is completed (FIG. 3 S22).

If a sheet on which image forming is to be done is not an insertion sheet (NO in FIG. 3 S17), after carrying out image forming on the front side of a normal recording sheet according to the image data of the front side of the document, this sheet is reversely conveyed, an image is formed on the back side of the sheet according to the image data on the back side of the document (FIG. 3 S18), and the sheet is straightly ejected as it is (FIG. 3 S19) under the control of the control section 101.

At this point, for the two recording sheets of double-sided recording sheet #1 (Page 1-Page 2) and double-sided recording sheet #2 (Page 3-Page 4), double-sided image forming with reverse conveying is carried out in this manner (see FIG. 5 (*c*) and (*d*)).

Next, since the third recording sheet is an insertion sheet (YES in FIG. 3 S17), after carrying out image forming only on the front side of the insertion sheet fed from the tray designated for the insertion sheet (FIG. 3 S20), the control section 101 reverses the insertion sheet in the reversing section 63 and ejects it (FIG. 3 S21). Herein, since a blank sheet insertion is actually designated, the data is a blank image data. Accordingly, no image forming is done, and the insertion sheet merely passes through the convey path of single-sided image forming and the reversing section 63.

Next, since the fourth and fifth recording sheets are not insertion sheets (NO in FIG. 3 S17), after carrying out image forming on the front side of the recording sheet according to the image data of the front side of the document, that sheet is reversely conveyed, image forming is done on the back side of the sheet according to the image data on the back side of the document (FIG. 3 S18), and the sheet is straightly ejected as it is (FIG. 3 S19), under the control of the control section 101.

In this manner, different image forming is done, depending on whether it is a normal recording sheet on to which a document is to be copied or an insertion sheet as a blank insertion sheet, for all the sheets until the image forming of all the image data of the corresponding job is completed (see FIG. 3 S22, FIGS. 5C and 5D).

As has been described above, in the first embodiment, when the inter-sheet mode (single-sided insertion or blank sheet insertion as the insertion sheet of the insertion mode) is designated in double-sided copying (double-sided document reading and double-sided image forming), not only the image reading section 120 is controlled so that no reading of the document is performed for the page corresponding to the insertion sheet in the image forming output while double-sided reading is performed for all other pages of the document, but also the print engine 180 is controlled so that, according to the image data obtained by reading, single-sided image forming is done after feeding a sheet from the tray of the insertion sheet for the page corresponding to the insertion sheet and the sheet is ejected without conveying it to the reverse conveying path, and double-sided image forming is performed by feeding normal recording sheets for all of the other pages.

Therefore, when carrying out a mixture of single-sided document reading and double-sided document reading, there is no need for operations and control of a programming job that handles the task as multiple jobs, and it is possible to carry out document reading and image forming as a case of a single integrated bundle. As a result, when carrying out a mixture of single-sided image forming and double-sided image forming, it is possible to execute the job efficiently without a drop in productivity due to reading of separate bundles.

Further, in the first embodiment, image forming based on image data obtained by reading is executed, according to the designation made via the input section while switching the feeding of sheets selectively from a plurality of trays, in a state in which single-sided image forming and double-sided image forming are mixed as a single job.

Therefore, when carrying out a mixture of single-sided image forming and double-sided image forming with sheet feeding from a plurality of trays, there is no need for operations and control of a programming job that handles the task as multiple jobs, and it is possible to carry out document reading and image forming as a case of a single integrated bundle. As a result, when carrying out a mixture of single-sided image forming and double-sided image forming, it is possible to execute the job efficiently without a drop in productivity due to reading of separate bundles.

Further, in the first embodiment, a display is made to prompt input, via the input section, of selection of designation of single-sided image forming (single-sided copying, single-sided blank sheet insertion) to be included in double-sided image forming, and the designation of the tray of recording sheets to make single-sided image forming included in double-sided image forming. When designation is input in accordance with this display, carried out is control of the single-sided image forming included in double-sided image forming, and of the sheet feeding from the designated tray of recording sheets during single-sided image forming included in double-sided image forming.

Therefore, when carrying out a mixture of single-sided image forming/double-sided image forming by feeding sheets from a plurality of trays, there is no need for operations and control of a programming job that handles the task as multiple jobs, and it is possible to carry out document reading and image forming as a case of a single integrated bundle. As a result, when carrying out a mixture of single-sided image forming/double-sided image forming, it is possible to execute a job efficiently without a drop in productivity due to, for example, reading separate bundles.

Figure 6:
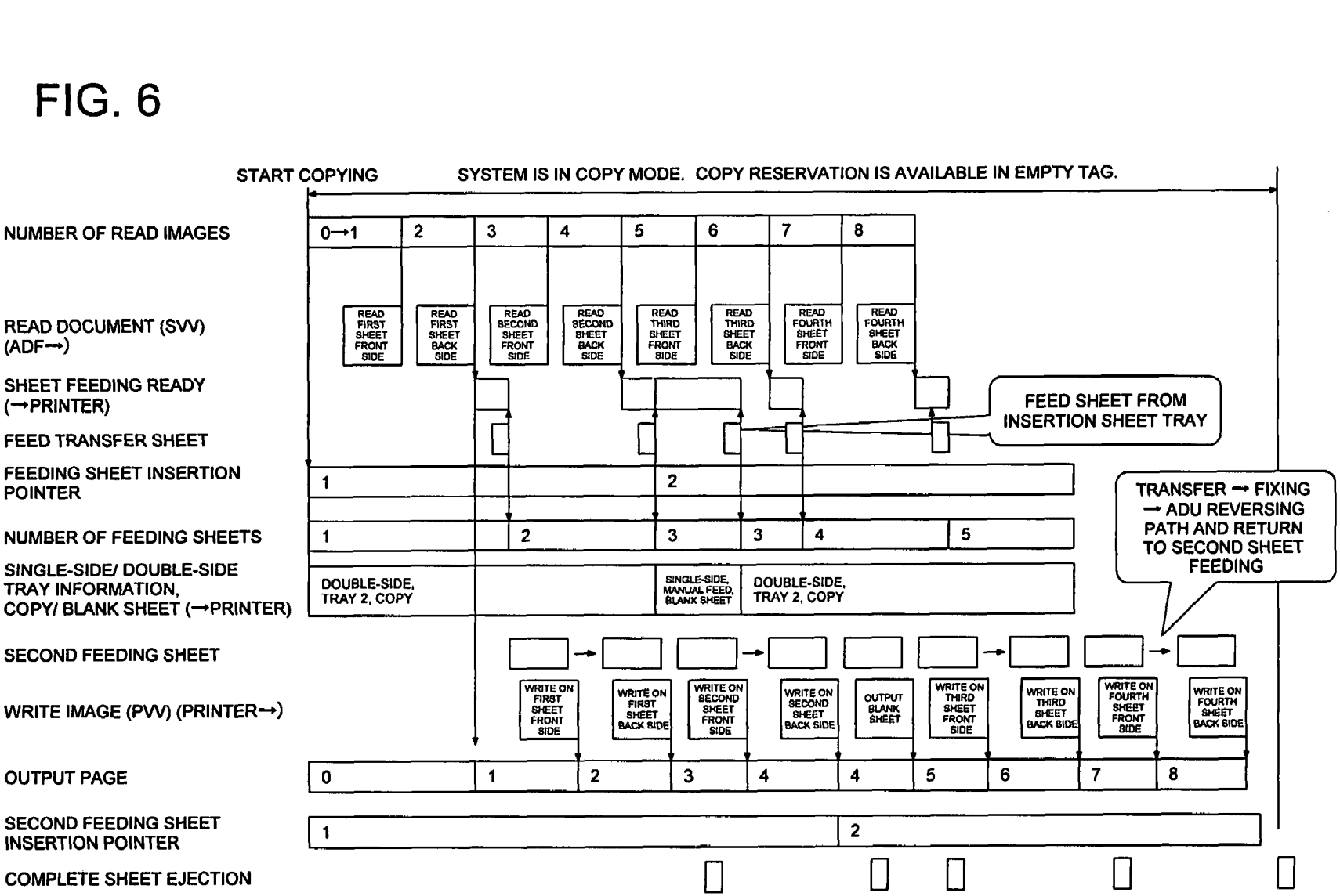
FIG. 6 is a time chart in realizing the operation in the first embodiment.

FIG. 6 is a time chart showing detail operation in the present above embodiment, which is the same case as that in FIG. 5.

Herein, an example is shown of obtaining image forming output (double-sided recording sheet #1 (Page 1-Page 2), double-sided recording sheet #2 (Page 3-Page 4), double-sided recording sheet #3 (Page 5-Page 6), and double-sided recording sheet #4 (Page 7-Page 8)) based on the documents shown in FIG. 5 (*a*) (double-sided document #1 (Page 1-Page 2), double-sided document #2 (Page 3-Page 4), double-sided document #3 (Page 5-Page 6), and double-sided document #4 (Page 7-Page 8)) and designation of the insertion sheet.

Further, in this FIG. 6, "a sheet feeding insertion pointer" is a pointer, related to sheet feeding, indicating the number storing the page to be inserted next, and is set to '1' at the time of starting copying, incremented by '+1' when a page insertion is executed. In addition, "the second sheet feeding insertion pointer" is a pointer, related to the second sheet feeding, indicating the number storing the page to be inserted next, and is set to '1' at the time of starting copying, incremented by '+1' when a page insertion is executed.

Further, at the time of carrying out the operations shown in FIG. 5 and FIG. 6, data is stored for each job in a memory area called the system memory in the image forming apparatus, with a data structure shown in FIG. 7. This data is divided into job data indicating the job status and page data indicating the status of each page.

Further, the items of a job data include—set number of copies, number of copies already output, copying mode, presence or absence of inter-sheets, insertion mode, designated page, tray for using recording sheets (main text), tray for insertion sheets, sheet feeding insertion pointer, second sheet feeding insertion pointer, number of images having been read, output page, etc., and their values are updated according to the progress of image reading and image forming. Also, the page data includes the image storage address for each page.

Herein, as a copying mode, set is the copying mode selected in the basic screen (FIG. 4A) (such as, single-sided to single-sided, single-sided to double-sided, double-sided to single-sided, and double-sided to double-sided, etc.). The presence or absence of inter-sheet is set to "Present" when the inter-sheet mode is selected on the application function setting screen (FIG. 4B).

The insertion mode set can be single-sided insertion/double-sided insertion, and blank sheet insertion/copy insertion for the insertion sheet. In the above embodiment, single-sided insertion and blank sheet insertion are designated.

The insertion page position designated on the inter-sheet mode setting screen is set as the 'designated page'. In the first embodiment, there are 30 locations of settings, and sorting is made in ascending order with the insertion page 1-30 being set.

The tray loaded with recording sheets of the same size as the tray for insertion sheets is selected automatically as the tray for main text (recording sheet tray). In the first embodiment, the tray #2 having the highest order of priority and the same size as the manual feed tray is selected.

The tray selected on the inter-sheet mode setting screen is set as the tray for insertion sheets. The manual feed tray is selected in this example.

The sheet feeding insertion pointer indicating a number related to sheet feeding stores the number of the page to be inserted next, and is set to '1' at the time of starting the copying, incremented by '+1' when a page insertion is executed. In addition, the "second sheet feeding insertion pointer" is a pointer, related to the second sheet feeding, indicating the number storing the page to be inserted next, and is set to '1' at the time of starting the copying, incremented by '+1' when a page insertion is executed.

The value '1' is set in the parameter "number of images having been read", and is incremented by '+1' at each SVV_OFF. In other words, this indicates the page number of the image to be read next, and the data related to the image that has been read is stored in the page data area of this number.

The "output page" indicates the page number of the image to be output next, and the data of the image that is to be output next is obtained from the data stored in the page data area of this number.

Further, the page data contains image storage address in the image memory for each page. The image storage address of the page data indicates the storage address in the image memory 106 at which each image data is stored in the compressed format.

Figure 8:
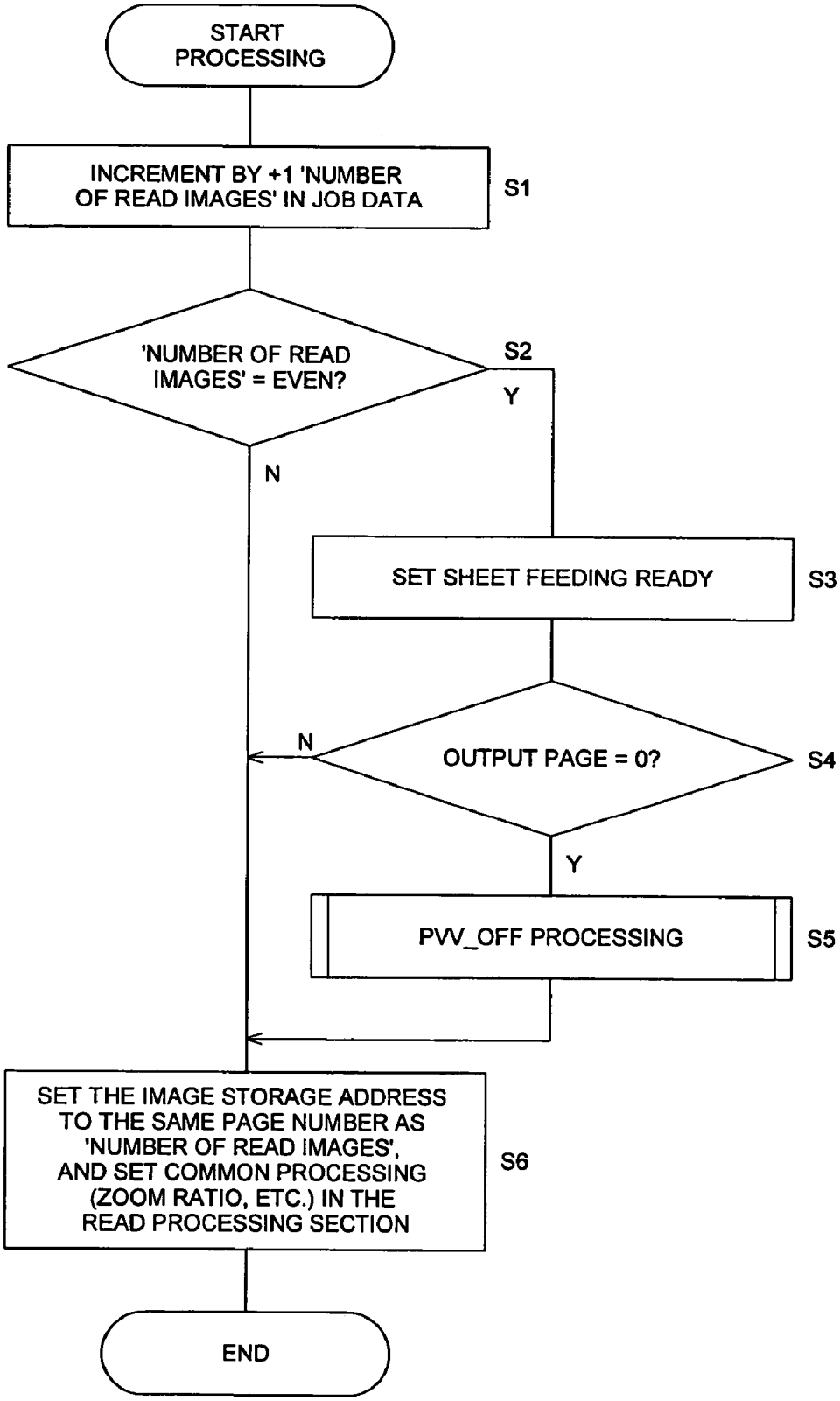
FIG. 8 is a flow chart showing operation in the first embodiment.

FIG. 8 is a flow chart processed at the time of SVV_OFF in the time chart shown in FIG. 6. In other words, when carrying out double-sided image forming from a double-sided document, this is the flow chart during SVV_OFF in the case where the inserted sheet is inserted as a single-sided sheet and also as a blank insertion sheet in the inter-sheet mode. Further, when carrying out double-sided image forming from a single-sided document, the following flow chart is applicable even during SVV_OFF in the case where the inserted sheet is inserted as a single-sided sheet and also as a blank insertion sheet in the inter-sheet mode.

Herein, "during SVV_OFF" implies the timing between one document and the next in image reading when 'Scan Vertical Valid' (sub scanning direction valid period of image reading) is invalid, in other words, this implies the timing after completing processing on the reading area or the timing immediately before the next processing.

First, at the instant of the SVV_OFF processing, the control section 101 increments the 'number of images having been read in the job data (FIG. 8 S1). This number of images having been read is set to '1' at the time of starting copying and is incremented by '+1' during SVV_OFF processing. In other words, this indicates the page number of the image to be read next.

Herein, the control section 101 judges whether the number of images having been read is even (FIG. 8 S2).

Herein, if the number of images having been read is even (YES in FIG. 8 S2), since SVV is OFF in the state after reading the front side of the document, the control section 101 prepares for double-sided image forming at this stage and sets the sheet feeding READY state (FIG. 8 S3) in order to prepare for the next reading.

Here, the control section 101 verifies the value of the output page in the job data, and judges if it is '0' (FIG. 8 S4). If the value of the output page is '0' (YES in FIG. 8 S4), the control section 101 executes the PVV_OFF process described later (FIG. 8 S5).

If the number of images read in is not even (NO in FIG. 8 S2), or if the output page value is not '0' (NO in FIG. 8 S4), or if the PVV_OFF process has been completed (FIG. 8 S5), the control section 101 sets the reading side and the image storage address in the "image type" of the page header of the "number of images" having been read in the job data. In addition, it also sets the common processings such as the magnification ratio, etc., in the read image processing section 107 (FIG. 8 S11). In other words, the preparations are made for the document to be read next. Thus, the control section 101 ends this SVV_OFF process.

Figure 9:
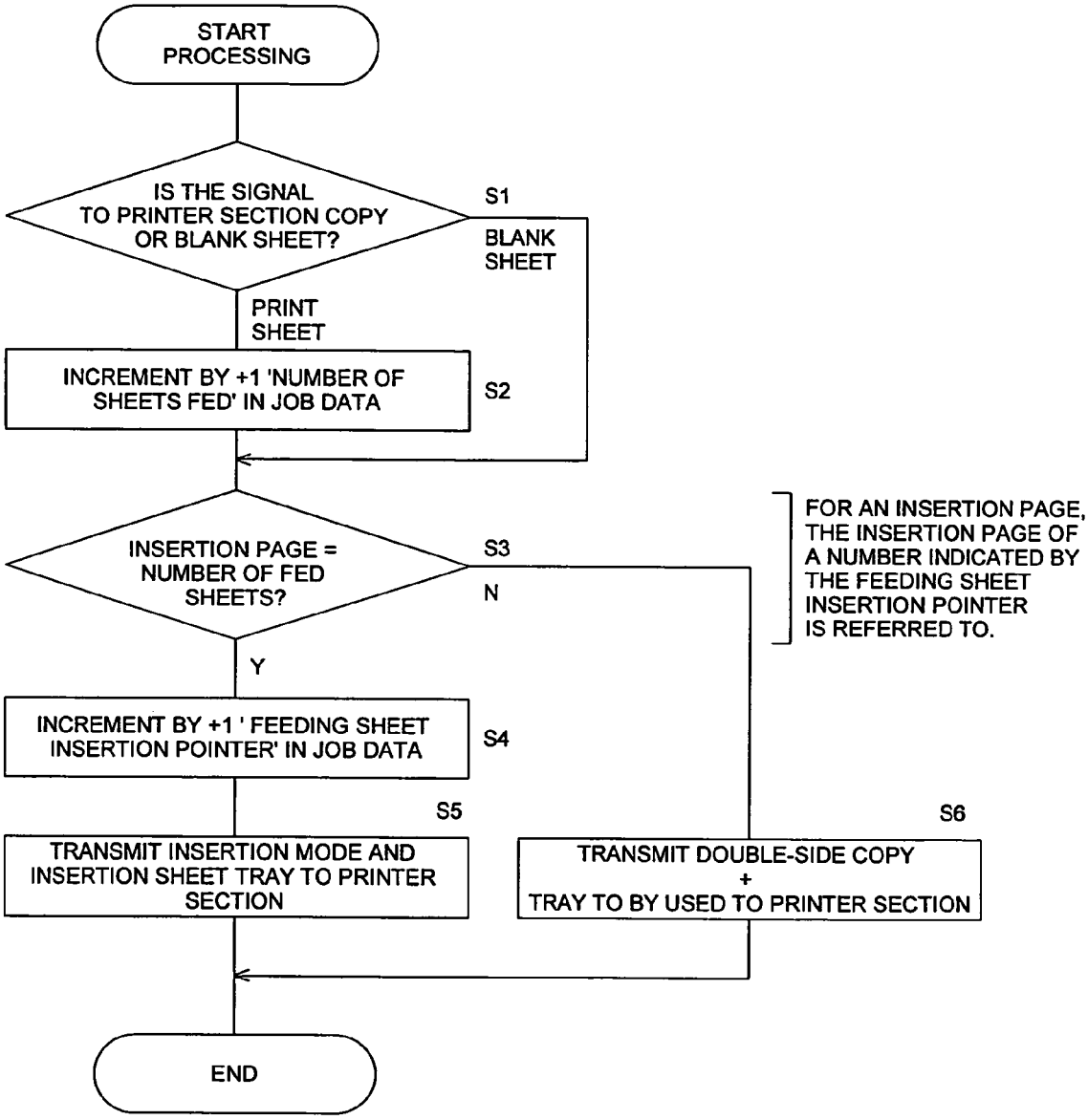
FIG. 9 is a flow chart showing operation in the first embodiment.

FIG. 9 is the flow chart processed at the time of sheet feeding READY_OFF in the time chart shown in FIG. 6. In other words, when carrying out double-sided image forming from a double-sided document, this is the flow chart during sheet feeding READY_OFF during the inter-sheet mode (single-sided insertion sheet, blank sheet insertion). Further, when carrying out double-sided image forming from single-sided documents, the following flow chart is applicable even during sheet feeding READY_OFF in the case where the inserted sheet is inserted as a single-sided sheet and also as a blank insertion sheet in the inter-sheet mode.

Herein, "during sheet feeding READY_OFF" implies the timing after executing sheet feeding in the sheet feeding tray until the sheet feeding READY status is set (FIG. 8 S3) when 'sheet feeding READY' is not valid, in other words, this implies the timing after completing the sheet feeding or before sheet feeding preparations are complete.

Herein, the control section 101 judges whether the image data to be used for the next image forming is image data for normal copying or blank image data for blank sheet insertion of the insertion sheet (FIG. 9 S1).

Herein, if it is an image data for normal copying (copy in FIG. 9 S1), the value of the number of sheets fed in the job data is incremented by +1 (FIG. 9 S2). If it is a blank image data for insertion sheet in case of a blank sheet insertion (blank sheet in FIG. 9 S1), the incrementing of the value of the number of sheets fed in the job data is not made. Herein, the number of fed sheets implies the number of recording sheets fed from a tray used for normal image forming.

Next, the control section 101 judges whether the insertion page indicated by the sheet feeding insertion pointer is equal to the above number of sheets having been fed (FIG. 9 S3).

Herein, if the insertion page accords with the number of fed sheets (YES in FIG. 9 S3), since the next sheet feeding corresponds to the timing of feeding an insertion sheet, the value of the sheet feeding insertion pointer in the job data is incremented by +1 (FIG. 9 S4). In addition, information on the insertion mode and the insertion sheet tray in the job data is transmitted by the control section 101 to the print engine 180 (FIG. 9 S5).

Further, at this time, if the insertion page is not equal to the number of fed sheets (NO in FIG. 9 S3), since the next sheet feeding is not that of an insertion sheet but is that of a normal recording sheet, information on the copy mode and the tray used (main text) in the job data is transmitted by the control section 101 to the print engine 180 (FIG. 9 S6). In this manner, the control section 101 terminates the sheet feeding READY_OFF process as the preparation for sheet feeding for the next image forming.

Figure 10:
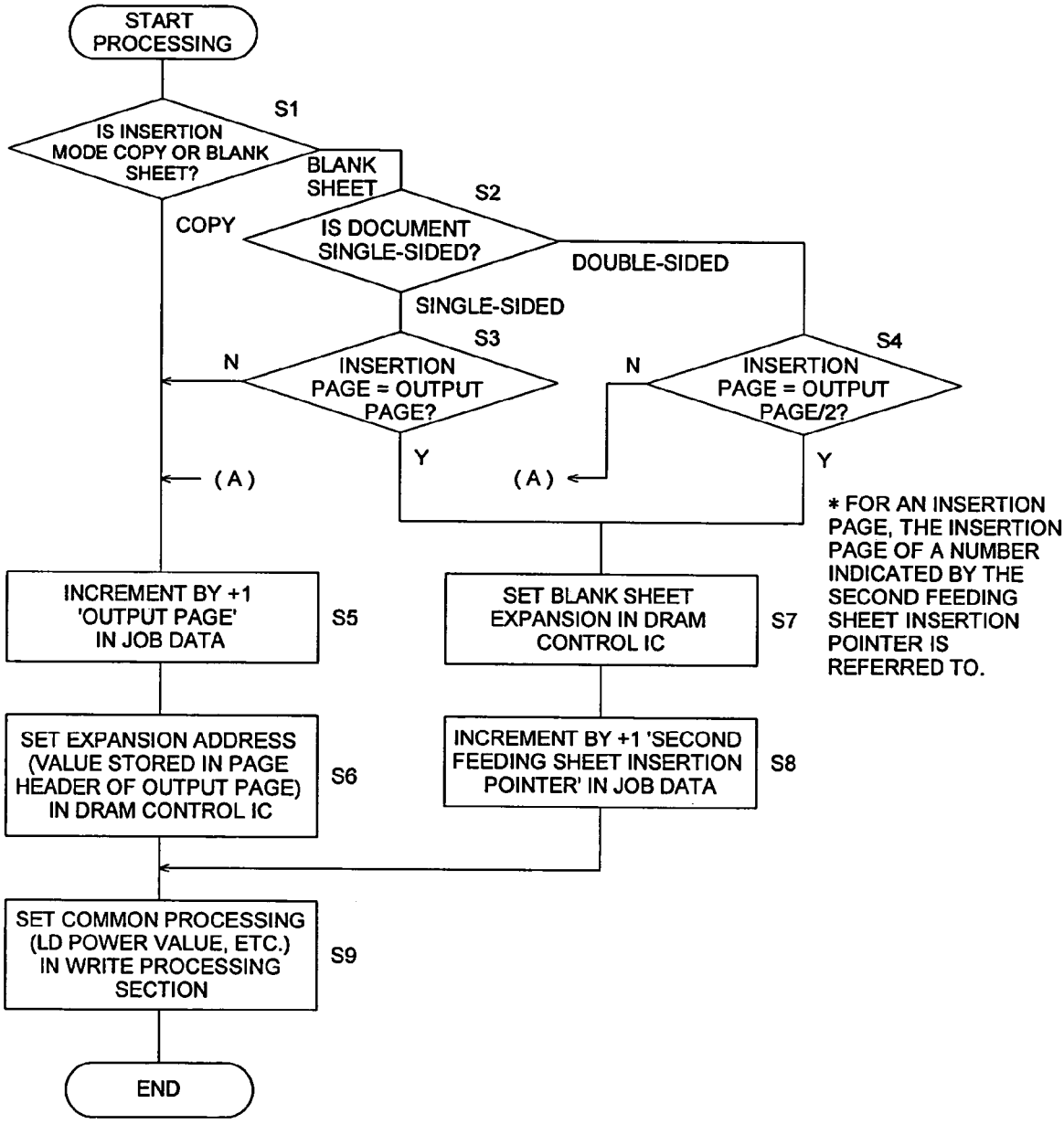
FIG. 10 is a flow chart showing operation in the first embodiment.

FIG. 10 is the flow chart of the processing made during PVV_OFF in the case of the data structure shown in FIG. 7 above. In other words, this is the flow chart during PVV_OFF in the case of the inter-sheet mode (single-sided insertion, blank sheet insertion) when double-sided image forming is performed based on a double-sided document.

Further, when carrying out double-sided image forming based on single-sided documents, the following flow chart can be applied even during the sheet feeding READY_OFF condition when the insertion sheet in the inter-sheet mode is being inserted as a single-sided insertion or a blank sheet insertion.

Herein, "during PVV_OFF" implies the timing between the execution of one image forming and the execution of the next image forming when 'Print Vertical Valid' (sub scanning direction valid period of image forming) is invalid, in other words, this implies the timing after completing the processing of the image forming area or the timing immediately before the execution of the next image forming.

In addition, this PVV_OFF processing is executed during the SVV_OFF processing described earlier, and is a subroutine called after the execution of image forming.

First, the control section 101 judges whether the image data to be image-formed next is a normal image data for copying or a blank image data for carrying out blank sheet insertion (FIG. 10 S1).

Herein, if the image data is not that of normal copying but is a blank image data of the insertion sheet inserting a blank sheet (blank sheet in FIG. 10 S1), it further judges whether the document to be copied is single-sided or double-sided (FIG. 10 S2).

Herein, if the image data is that of normal copying (print sheet in FIG. 10 S1), when the insertion page is not equal to the output page during the image forming of a single-sided document (NO in FIG. 10 S3), or when the insertion page is not equal to (output page/2) during the image forming of a double-sided document (NO in FIG. 10 S4), since the timing of the next image forming is not that of an insertion sheet but is that of normal recording sheet, the control section 101 increments by +1 the output page in the job data (FIG. 10 S5). This output page indicates the page number of the image to be output next. The data related to the image to be output is the data stored in the page data area (See FIG. 7) corresponding to this number.

Next, the control section 101 sets the expanded address (the value stored in the page header of the output page) in the DRAM control IC (not shown in the figure) provided inside the control section 101 for controlling the image memory 106 (FIG. 10 S6). In other words, preparation is made for outputting the image data of the image to be formed next.

Further, herein, when the insertion page is equal to the output page during the image forming of a single-sided document (YES in FIG. 10 S3) or when the insertion page is equal to (output page/2) during the image forming of a double-sided document (YES in FIG. 10 S4), since the timing of the next image forming is that of an insertion sheet, the control section 101 sets the expanded address (the value stored in the page header of the output page) of the blank image data for carrying out blank sheet insertion in the DRAM control IC (not shown in the figure) provided inside the control section 101 for controlling the image memory 106 (FIG. 10 S7). In other words, preparation is made for outputting the image data of a blank sheet for carrying out the next image forming which is that of an insertion sheet.

Further, the control section 101 increments by +1 the second sheet feeding insertion pointer in the job data (FIG. 10 S8). This "second sheet feeding insertion pointer" is a pointer related to the second sheet feeding and indicates the number storing the page to be inserted next, and is set to '1' at the time of starting the copying, incremented by '+1' when a page insertion is executed.

Further, at the end of this PVV_OFF processing, the control section 101 sets the common process (the LD password value, etc. in the print engine 180) in the write image processing section 108 (FIG. 10 S9). In other words, preparations are made for carrying out the next image forming. In this manner, the control section 101 terminates the PVV_OFF of processing in preparation for the next image forming.

As is shown in the flow charts of FIG. 8 to FIG. 10, data with the structure shown in FIG. 7 is stored for each job in the memory area called the system memory in the image forming apparatus. By executing the SVV_OFF process of FIG. 8, the sheet feeding READY_OFF process of FIG. 9, and the PVV_OFF process of FIG. 10, as is shown in FIG. 5 and FIG. 6, at the time of executing a mixture of single-sided image forming and double-sided image forming with sheet feeding from a plurality of trays, operations and control as a programming job handling the task as multiple jobs become unnecessary, and it is possible to carry out document reading and image forming as a case of a single integrated bundle. As a result of this, when carrying out a mixture of single-sided image forming/double-sided image forming, it is possible to execute the job efficiently without a drop in productivity due to, for example, reading separate bundles.

Other Examples in the First Embodiment

Further, in the example of the above embodiment, although, in order to simplify the explanations, the number of circulating sheets in image forming was taken as '1', it is also possible that there are multiple circulating sheets and it is possible to read them efficiently in a single batch reading without a drop in productivity due to, for example, reading separate bundles.

Further, in the example of the above embodiment, at the time of reading a double-sided document and carrying out double-sided image forming operation, although the insertion of an insertion sheet was executed according to the settings input from the operation and display section 103, it is also possible to execute the insertion of an insertion sheet according to the settings input from the operation and display section 103 in reading single-sided documents and carrying out double-sided image forming.

Further, in the example in the above embodiment, in reading a double-sided document and carrying out double-sided image forming operation, although the insertion of a blank sheet or a single-sided insertion sheet was executed according to the settings input from the operation and display section 103, it is also possible, to carry out insertion of print sheet as the insertion sheet in which the image of the document is copied, according to the settings input from the operation and display section 103.

In addition, according to the settings input from the operation and display section 103, when carrying out insertion of print sheet as the insertion sheet in which the image of the document is copied, it is possible to carry out not only single-sided insertion in which the image of the document is copied on one side of the insertion sheet but also to carry out double-sided insertion in which the image of the document is copied on both sides of the insertion sheet.

Further, in the example in the above embodiment, in reading a double-sided document and carrying-out double-sided image forming operation, although the feeding of the insertion sheet was selected from a different tray according to the settings input from the operation and display section 103, it is also possible to use a sheet from the same tray as those for recording sheets of main text.

Second Embodiment

An image forming apparatus according to a second embodiment of the present invention is described in the following. Although in this embodiment, the basic structure is an image forming apparatus (copying apparatus) provided with a function to read the content of the object of copying (the original document) as image information using a document reading section (a scanner) and copying it, the embodiment of the present invention can be applied even in the case of an image forming system constructed by a scanner, a computer, and a printer.

Further, in the second embodiment of the present invention, the description is given concretely for an image reading device having a function to generate image data by reading an image while conveying a document, that is, an image reading device or an image forming apparatus that has an image reading device such as solid image pick-up device of plural pixels along the main scanning direction and carries out two-dimensional reading (sheet through type reading) in the main scanning direction and the sub scanning direction by moving a document along the sub scanning direction with respect to the image reading device.

Further, in the image forming apparatus in the second embodiment, since the electrical structure shown in FIG. 1 and the mechanical structure shown in FIG. 2 are the same as those of the first image forming apparatus described above, repeated description will be omitted.

In the following, the operation of the image forming apparatus according to the second embodiment of the present invention, that is, the procedure of the image forming apparatus controlling method is explained here in detail referring to the flow chart of FIG. 11 and the operation inputs by the operator via the operation and display section 103 shown in FIG. 12.

Further, FIG. 12 is an example of the basic screen displayed in the operation and display section 103 based on the control of the control section 101. Herein, FIG. 12A is an explanatory diagram showing the basic screen for making various types of basic settings, FIG. 12B is an application function setting screen for selecting the application function, and FIG. 12C is an inter-sheet setting screen on which the designations are made for the tray of the insertion sheet and the insertion page position of the insertion sheet in the inter-sheet mode (the function of inserting an insertion sheet into recording sheets) which is one of the application functions.

First, the basic screen (FIG. 12A) is displayed in the operation and display section 103 under the control of the control section 101, and designation input by the operator is prompted.

Figure 11:
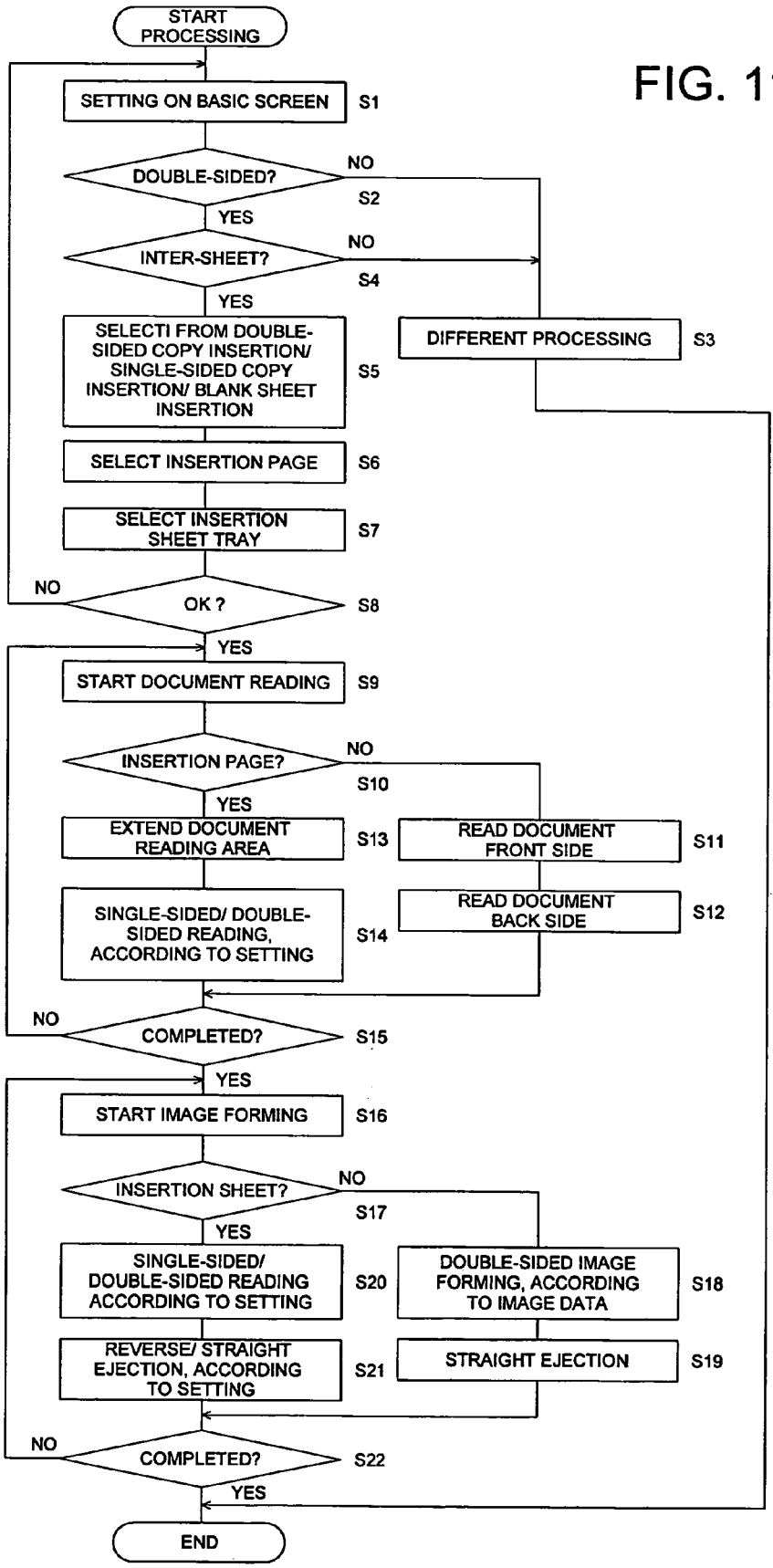
FIG. 11 is a flow chart showing operation in a second embodiment of the present invention.

In settings of the basic screen of this FIG. 12A, it is assumed that settings of double-sided copying of a double-sided document (FIG. 12A (1)) and the A4 size recording sheet in tray # 2 (FIG. 12A (2)) are selected by the operator (FIG. 11 S1).

Herein, if it is not a double-sided document (NO in FIG. 11 S2), since it is single-sided document reading or single-sided image forming, the control section 101 executes a different process such as single-sided processing, etc. (FIG. 11 S3). Further, detailed description is omitted in this embodiment regarding single-sided reading and single-sided image forming operations.

It is also assumed that the selection of application function (FIG. 12A (3)) is made by the operator in the settings on this basic screen.

Further, when no application function is selected (NO in FIG. 11 S4), the control section 101 executes a different process such as normal operations, etc (FIG. 11 S3). Also, detailed description is omitted regarding the normal operations in this embodiment.

When an application function is selected by the operator on the basic screen (FIG. 12A (3)), the control section 101 displays, on the operation and display section 103, the application function setting screen shown in FIG. 12B. In other words, the application function setting screen (FIG. 12B) is displayed on the operation and display section 103 under the control of the control section 101 and designation input by the operator is prompted.

The application functions available are—the inter-sheet mode, chapter division, black-white reversal, repeat, frame/folding line erasure, full page image, binding margin, stamp/overlay, etc. In the second embodiment, it is assumed that the operator selects the inter-sheet mode (FIG. 12B (4)) and presses the "OK" button (FIG. 12B (5), YES in FIG. 11 S4)

Further, when an application function other than the inter-sheet mode is selected (NO in FIG. 11 S4), the control section 101 executes a different process corresponding to the respective selected application function (FIG. 11 S3). Further, detailed description of other application functions in this embodiment is omitted.

When the inter-sheet mode is selected by the operator (FIG. 12B (4) (5)) on the application function setting screen, the control section 101 displays, on the operation and display section 103, the insertion mode setting screen, shown in FIG. 12C. In other words, the insertion mode setting screen (FIG. 12C) is displayed by the control section 101 on the operation and display section 103, and input of designations by the operator is prompted.

The selections and designations in this insertion mode can be—selection of single-sided copy insertion or double-sided copy insertion or blank sheet insertion, as copy insertion, designation of the tray of insertion sheet different from the recording sheets used for normal image forming, designation of the insertion page position of that insertion sheet, etc.

In the second embodiment, if the selection of single-sided copy insertion (FIG. 12C (6)) and also the selection of setting of insertion page (FIG. 12C (7)) are made by the operator (FIG. 11 S5), the control section 101 accepts input from the ten-keys of the page number at which the insertion page is to be inserted.

If double-sided copying is to be made on an insertion sheet at the time of carrying out double-sided copying on a recording sheet, since it is continuous double-sided copying, the detailed explanations of this case will be omitted here. Further, in carrying out double-sided copying on a recording sheet, if a blank sheet is to be inserted as an insertion sheet, it is the same as the first embodiment described above, and hence the explanations of such a case will be omitted here.

Herein, it is assumed that the third page is selected as the position of the insertion sheet (FIG. 12C (8)) by the operator (FIG. 11 S6).

Further, in the second embodiment, if switching of the tray of the insertion sheet is selected (FIG. 12C (9)), the control section 101 displays the tray selection screen (not shown in the figure) on the operation and display section 103, and accepts a switching of the tray of the insertion sheet. Herein, it is assumed that the manual sheet feed tray in which tab sheets (index sheets) are mounted is selected as the tray of the insertion sheet (FIG. 12C (10)) (FIG. 11 S7). In other words, when a tray having tab sheets is selected as the tray of the insertion sheet, a tab sheet will be inserted as the insertion sheet at a designated page position.

Here, when the settings are completed on the above application function setting screen, on the insertion mode setting screen, and on the inter-sheet mode setting screen, the operator selects "OK" (FIG. 12C (12)) (YES FIG. 11 S8), whereby the setting is completed for obtaining a copied matter (image forming output matter) of a mixture of single-sided and double-sided image forming including single-sided copying on an inserted sheet such as a tab sheet. Thereafter, the control section 101 retains the settings and selections input via the operation and display section 103 in the non-volatile memory 105.

Next, the control section 101, based on the above settings, gives instructions to the ADF 110 and the image reading section 120, and starts image reading (FIG. 11 S9). Herein, it is assumed that documents to be read are, as shown in FIG. 5 (*a*), in the sequence of double-sided document #1 (Page 1-Page 2), double-sided document #2 (Page 3-Page 4), a single-sided document for an insertion sheet, double-sided document #3 (Page 5-Page 6), and double-sided document #4 (Page 7-Page 8).

Herein, the control section 101 refers to the settings input by the operator on each of the screens described above (basic screen, application function settings screen, and inter-sheet mode setting screen), and judges whether the document to be read corresponds to the insertion sheet (single-sided copy page) (FIG. 11 S10). Further, according to whether it is generation of image data by reading a normal document or generation of image data by reading for the insertion sheet (single-sided copy page) as described below, the control section 101 continues to read until all documents are read (FIG. 11 S15).

If a document to be read does not correspond to the insertion sheet (single-sided copy page) in the image forming output (NO in FIG. 11 S10), under the control of the control section 101, the front side of the document is read (FIG. 11 S11) by the image reading section 120 while the document is conveyed by the ADF 110, and then the document is reversed by the ADF 110. Subsequently, while conveying the same document by the ADF 110, its back side is read (FIG. 11 S12), and the document is reversed and then ejected. Herein, the front side and the back side of each of two sheets of documents, that is, double-sided document #1 and double-sided document #2 are read in this manner and image data is generated (see FIG. 5 (*b*)). The image data obtained by reading in this manner is stored by the control section 101 in the image memory 106.

Thereafter, since the third sheet corresponds to the insertion sheet (single-sided copy page) in the image forming output (YES in FIG. 11 S10), when the document in making a single-sided copy insertion is a tab sheet, the control section 101 extends the reading area by an amount corresponding to the tab part (FIG. 11 S13). Thereafter, since the setting is of a single-sided copy insertion, under instruction from the control section 101, the front side of the document which is a tab sheet is read by the image reading section 120 while being conveyed by the ADF 110 (FIG. 11 S14), and the document is ejected as it is by the ADF 110 (see FIG. 5 (*b*)).

Thereafter, since the double-sided document #3 and double-sided document #4 do not correspond to an insertion sheet (single-sided copy page) (NO in FIG. 11 S10), under the control of the control section 101, the front side of the document is read (FIG. 11 S11) by the image reading section 120 while the document is conveyed by the ADF 110, and then the document is reversed by the ADF 110. Subsequently, while conveying the same document by the ADF 110, its back side is read (FIG. 11 S12), and the document is reversed and then ejected (see FIG. 5 (*b*)).

Further, the image data obtained by the reading operation is first subjected to image processing during reading by the read image processing section 107, and is stored in a unit of a job in the image memory 106 based on instructions from the control section 101.

In the above reading operations, for a mixture of single-sided and double-sided documents including a single-sided document such as a tab document etc., it is possible to read efficiently in one batch reading without using a dedicated sensor, and also, without a drop in productivity due to reading separate bundles.

Further, when the above image reading is completed, the control section 101 gives instructions to the write processing section 108 and the print engine 180 and starts image forming (FIG. 11 S16). Even if reading all documents has not been completed, it is possible to start image forming when reading of at least the first double-sided document #1 has been completed.

Figure 13:
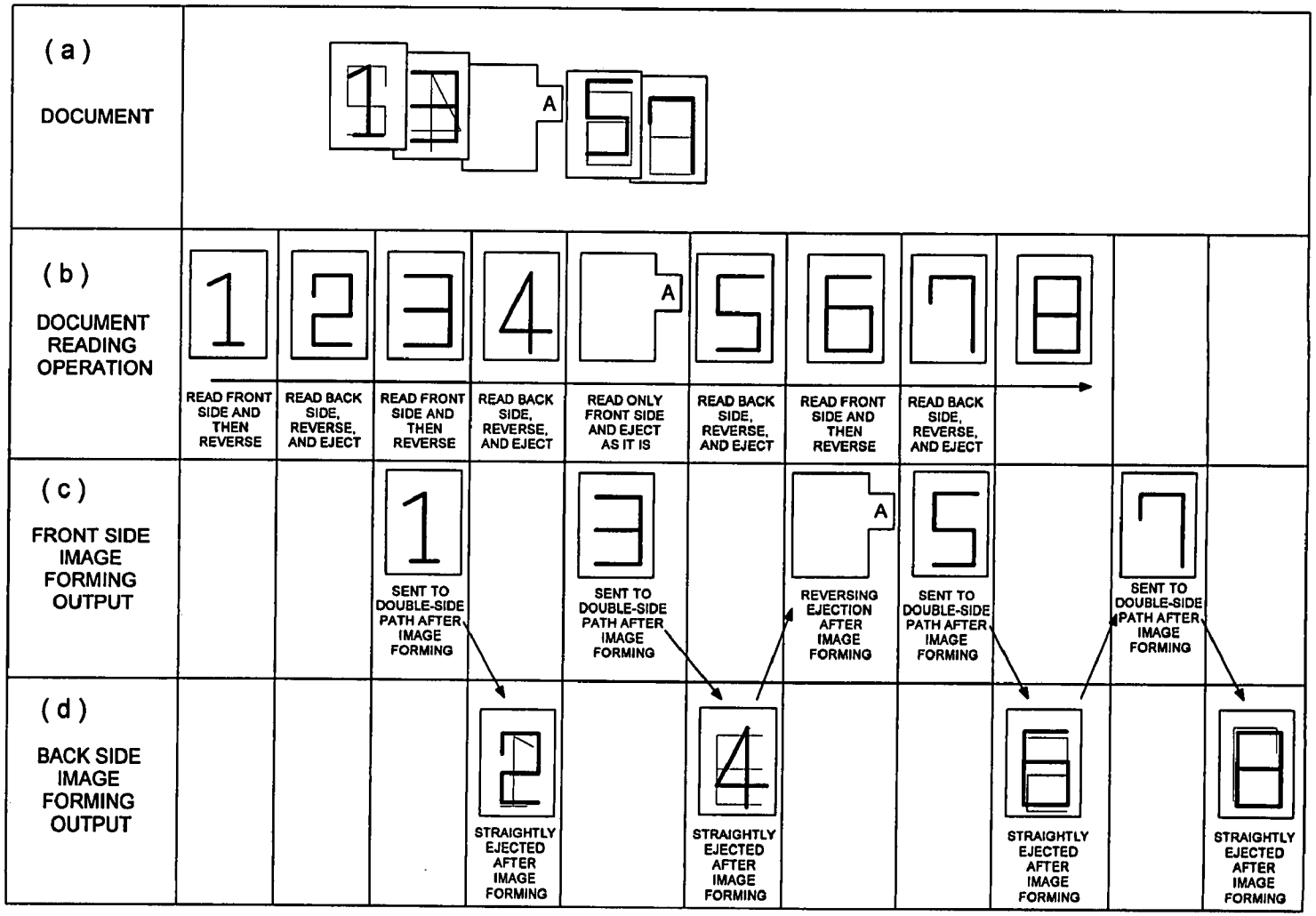
FIG. 13 is a time chart in realizing the operation in the second embodiment.

Herein, image forming is carried out so as to obtain image forming output in accordance with the settings (double-sided copy, double-sided copy, single-sided copy, double-sided copy, double-sided copy) made for the documents shown in FIG. 13 (*a*) (double-sided document #1 (Page 1-Page 2), double-sided document #2 (Page 3-Page 4), single-sided document (tab sheet) for the insertion sheet, double-sided document #3 (Page 5-Page 6), and double-sided document #4 (Page 7-Page 8)).

Further, the control section 101 refers to the input of settings made by the operator on each of the above screens (basic screen, application function settings screen, and inter-sheet mode setting screen), and makes a judgment as to whether it is a normal recording sheet or an insertion sheet (FIG. 11 S17).

Further, the control section 101 continues as follows different image forming depending on whether it is an normal recording sheet or an insertion sheet for all the sheets until the image forming of all the image data of the corresponding job has been completed (FIG. 11 S22).

If a sheet on which image forming is to be performed is not an insertion sheet (NO in FIG. 11 S17), an image is formed on the front side of a normal recording sheet according to the image data of the front side of the document under the control of the control section 101, then the sheet is reversely conveyed, image forming is performed on the back side of the sheet according to the image data on the back side of the document (FIG. 11 S18), and the sheet is straightly ejected as it is (FIG. 11 S19).

Herein, for two recording sheets of double-sided recording sheet #1 (Page 1-Page 2) and double-sided recording sheet #2 (Page 3-Page 4), double-sided image forming with reverse conveying is carried out in this manner (see FIG. 13 (*c*) and (*d*)).

Next, since the third recording sheet is an insertion sheet (YES in FIG. 11 S17), the control section 101 carries out image forming on the side designated for image forming on the insertion sheet fed from the tray described for the insertion sheet (FIG. 11 S20). Subsequently, according to the setting of the image forming side, the insertion sheet is reversed in the reversing section 63 and is ejected if single-sided image forming has been designated, or, the insertion sheet is straightly ejected if double-sided image forming has been designated (FIG. 11 S21). Further, in the case of blank sheet insertion, no image forming is performed but the insertion sheet merely passes through the convey path for single-sided image forming and the reversing section 63.

Next, since the fourth and fifth recording sheets are not insertion sheets (NO in FIG. 11 S17), an image is formed on the front side of a normal recording sheet according to the image data of the front side of the document under the control of the control section 101, and the sheet is reversely conveyed. An image is formed on the back side of the sheet according to the image data on the back side of the document (FIG. 11 S18), and the sheet is straightly ejected as it is (FIG. 11 S19).

In this manner, operation, namely, double-sided copying of a document on a normal recording sheet, copying of a side, having been set, of a document on an insertion sheet, or inserting a blank insertion sheet is continued until image forming of all the image data of the corresponding job has been completed (see FIG. 11 S22, FIG. 13 (*c*) and (*d*)).

As has been described above, in the second embodiment, according to the designations made via the operation and display section 103, the image reading section 120 is controlled so as to carry out document reading as a single job in a state in which single-sided reading and double-sided reading are present in a mixture, and the image forming based on the image data obtained by reading is executed as a single job in a state in which single-sided image forming and double-sided image forming are present in a mixture. Therefore, when carrying out a mixture of single-sided document reading/double-sided document reading and a mixture of single-sided image forming/double-sided image forming, there is no need for operations and control of a programming job that handles the task as multiple jobs, and it is possible to carry out document reading and image forming as a case of a single integrated bundle. As a result, when carrying out a mixture of single-sided document reading/double-sided document reading and of single-sided image forming/double-sided image forming, it is possible to execute the job efficiently without a drop in productivity due to reading separate bundles.

Further, in the second embodiment, according to the designations made via the operation and display section 103, the image reading section 120 is controlled so as to carry out document reading as a single job in a state in which single-sided reading and double-sided reading are present in a mixture, and image forming based on image data obtained by reading is executed as a single job in a state in which single-sided image forming and double-sided image forming are present in a mixture, while selectively switching sheet feeding from a plurality of trays. Therefore, when carrying out a mixture of single-sided document reading/double-sided document reading and single-sided image forming/double-sided image forming by feeding sheets from a plurality of trays, there is no need for operations and control of a programming job that handles the task as multiple jobs, and it is possible to carry out document reading and image forming as a case of a single integrated bundle. As a result, when carrying out a mixture of single-sided document reading/double-sided document reading and single-sided image forming/double-sided image forming, it is possible to execute the job efficiently without a drop in productivity due to reading separate bundles.

Further, in the second embodiment, a display is made to prompt for input, via the operation and display section 103, regarding single-sided image forming to be included in double-sided image forming, and regarding selection of designation regarding a tray of recording sheets to be used in the single-sided image forming to be included in the double-sided image forming, and when the input of these designations is made in response to this display, control is carried out so as to execute the single-sided image forming to be included in double-sided image forming, sheet feeding from the tray of the recording sheet to be used during the single-sided image forming included in the double-sided image forming, and the single-sided document reading to be included in double-sided document reading. Therefore, when carrying out a mixture of single-sided document reading/double-sided document reading and a mixture of single-sided image forming/double-sided image forming by feeding sheets from a plurality of trays, there is no need for operations and control of a programming job that handles the task as multiple jobs, and it is possible to carry out document reading and image forming as a case of a single integrated bundle. As a result, when carrying out a mixture of single-sided document reading/double-sided document reading and a mixture of single-sided image forming/double-sided image forming, it is possible to execute the job efficiently without a drop in productivity due to reading separate bundles.

Further, in the second embodiment, in accordance with designation of image forming side for an insertion sheet (designation of double-sided or single-sided image forming), a determination is made as to whether to carry out single-sided or double-sided reading of a corresponding document. In particular, when the designation of image forming side for the insertion sheet is single-sided image forming, control is carried out so that a document corresponding to the position of the insertion sheet-(for example, page position) for which single-sided image forming is designated is subjected to single-sided reading.

Thus, in a job in which double-sided reading and single-sided reading of documents are present in a mixture, it is possible to relieve the user from tedious setting of the position of a document at which single-sided reading is to be performed and from tedious loading of documents in plural times to read the documents in plural times, thereby achieving efficient image reading and image forming.

Furthermore, also in the second embodiment, the control section 101 can also judge whether double-sided image forming is possible or not on an insertion sheet, according to the designation from the user about the image forming side of the insertion sheet (designation as to whether double-sided or single-sided image forming), the designation of blank sheet insertion, or the type of medium of the insertion sheet. When making the determination based on the type of medium of the insertion sheet, although it is possible to make the judgment based on the type of medium input by the user, it is also possible to make the judgment by storing, in advance, the correspondence between the tray having the insertion sheets and the type of medium, and reading the type of the medium that is stored, in accordance with the selection of the tray having the insertion sheet to be used. It is preferably judged that double-sided image forming is not possible when the type of medium of the insertion sheet is at least one of—tab sheets, backing sheets (sheets on one side of which an image has already been formed, pre-printed sheets), and paperboards.

Other Examples in the Second Embodiment

Further, in the example of the above embodiment, although, in order to simplify the description, the number of circulating sheet in image forming was taken as '1', it is also possible that there are multiple circulating sheets and it is possible to read them efficiently in a single batch reading without a drop in productivity due to, for example, reading separate bundles.

Further, in the example of the above embodiment, at the time of reading a double-sided document and carrying out double-sided image forming operation, the insertion of a single-sided insertion sheet for single-sided copying was executed according to the settings input from the operation and display section 103. It is also possible to execute the insertion of a single-sided insertion sheet for single-sided copying, according to the settings input from the operation and display section 103 at the time of reading a single-sided document and carrying out double-sided image forming.

Further, in the example of the second embodiment, in reading a double-sided document and carrying out double-sided image forming operation, feeding of insertion sheets was selected from a different tray, according to the settings input from the operation and display section 103. It is also possible to use a sheet from the same tray for recording sheets of main text, as an insertion sheet.

Third Embodiment

In the above first embodiment and second embodiment, although a copying machine was taken as an example, the present invention can also be applied to image forming apparatuses such as printers. In other words, in the third embodiment, an example is given of an image forming apparatus such as a printer in which it is possible to obtain image forming output, receiving image data from outside.

Further, in FIG. 1 and FIG. 2, the parts, excluding units for reading images of documents such as the ADF 110 (10), the image reading section 120 (20), and the read image processing section 107, correspond to an image forming device such as a printer.

In other words, it is assumed that an image forming apparatus according to this third embodiment includes at least a print engine as image forming means having functions to selectively feed recording sheets stored in one of plurality of trays and to form images according to the image data on both sides of the recording sheets, an operation and display section 103 as designation input means having a function to receive, as an inter-sheet mode, designation of insertion sheets different from recording sheets used for image forming and as display means, and a control section 101 as controlling means for controlling image forming.

Further, also in the third embodiment, the control section 101 can judge whether double-sided image forming is possible or not on the insertion sheet according to the designation from the user of the image forming side of the insertion sheet (designation as to whether double-sided or single-sided image forming) or designation of blank sheet insertion, or according to the type of medium of the insertion sheet. When making the determination based on the type of medium of the insertion sheet, although it is possible to make the judgment based on the type of medium input by the user, it is also possible to make the judgment by storing, in advance, the correspondence between the tray having the insertion sheets and the type of medium and reading out the type of the medium that is stored in accordance with the selection of the tray having insertion sheets to be used. It is preferable to judge that double-sided image forming is not possible when the type of medium of the insertion sheet is at least one among—tab sheets, backing sheets (sheets on one side of which images have already been formed, pre-printed sheets), and paperboards.

In the following, the operation of an image forming apparatus according to the third embodiment is explained referring to the flow chart in FIG. 14.

Figure 14:
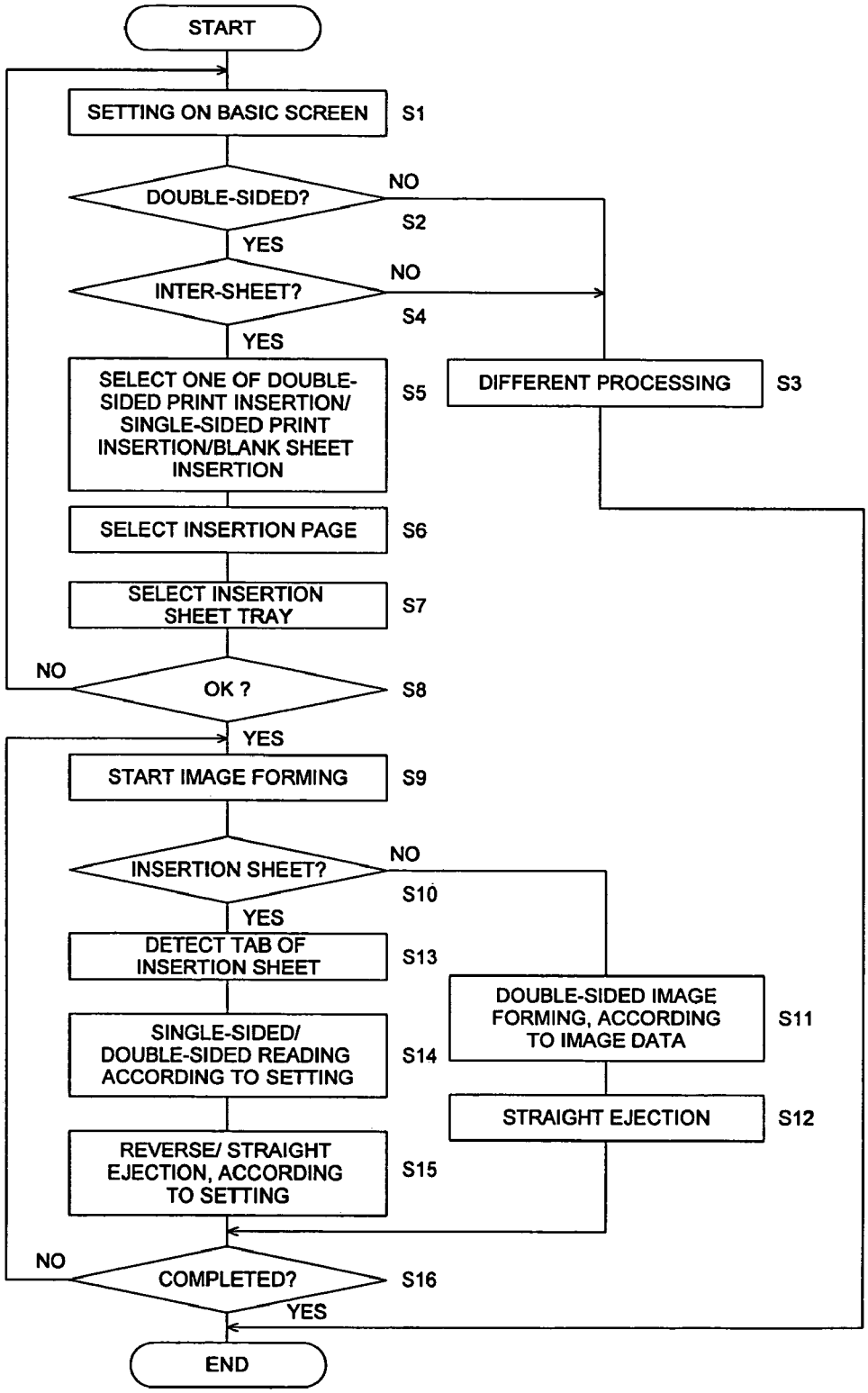
FIG. 14 is a flow chart showing operation in a third embodiment of the present invention.

In an image forming apparatus of this kind, in carrying out image forming based on image data, the control section 101 displays, to the user on the operation and display section 103, an inquiry regarding the presence or absence of inter-sheet mode such as "Execute inter-sheet mode?" in the basic settings screen (FIG. 14 S1).

Here, if double-sided image forming is not selected (NO in FIG. 14 S2), since the image forming is single-sided, the control section 101 executes a different process such as single-sided processing (FIG. 14 S3). Further, detailed description will be omitted in this embodiment for single-sided image forming operations. Likewise, since the image forming is normal image forming when the inter-sheet mode is not selected (NO in FIG. 14 S4), the control section 101 executes a different process (FIG. 14 S3). Further, detailed description of image forming operations, in this embodiment, performed when the mode is not the inter-sheet mode will be omitted.

When the selection of executing the inter-sheet mode is input by the operator via the operation and display section 103 (YES in FIG. 14 S4), the control section 101 displays an inquiry message on the operation and display section 103 as to whether to carry out double-sided print sheet insertion, single-sided print sheet insertion, or blank sheet insertion for the insertion sheet (FIG. 14 S5).

When the selection of executing double-sided print sheet insertion, single-sided print sheet insertion, or blank sheet insertion is input by the operator on the operation and display section 103 (YES in FIG. 14 S5), the control section 101 displays an inquiry message, on the operation and display section 103, about the page at which the insertion page is to be inserted (FIG. 14 S6).

When the selection of the page at which the insertion page is to be inserted is input by the operator via the operation and display section 103 (FIG. 14 S6), the control section 101 displays an inquiry message, on the operation and display section 103, about the tray from which to feed the insertion sheet (FIG. 14 S7).

Herein, when the above settings of the selection of the inter-sheet mode are completed by the operator via the operation and display section 103 (YES in FIG. 14 S8), the control section 101, according to the above settings, gives instructions to the write processing section 108 and the print engine 180, and starts image forming (FIG. 14 S16).

Herein, the control section 101 refers to the input of the above settings related to the inter-sheet mode by the operator, and judges whether a recording sheet on which the image forming is to be performed is a normal recording sheet or an insertion sheet (FIG. 14 S10).

Next, the control section 101 continues to carry out different image forming, according as to whether a sheet is a normal recording sheet or insertion sheet, until the image forming based on all the image data of the job is completed (FIG. 14 S16).

If the sheet on which image forming is to be performed is not an insertion sheet (NO in FIG. 14 S10), an image is formed on the front side of a normal recording sheet according to the image data of the front side of the document under the control of the control section 101, the sheet is reversely conveyed, then, image forming is done on the back side of the sheet according to the image data on the back side of the document (FIG. 14 S11), and the sheet is straightly ejected as it is (FIG. 14 S12).

Herein, if the sheet on which image recording is to be performed is an insertion sheet (YES in FIG. 14 S10), under the control of the control section 101, a tab of the insertion sheet is detected (FIG. 14 S13), and it is conveyed to the image forming conveying path for single-sided image forming, double-sided image forming, or blank sheet insertion according to the setting made by the operator (FIG. 14 S14). In other words, the control section 101 carries out image forming on the designated side, on which to form an image, of the insertion sheet fed from the tray designated for insertion sheets. Next, according to the setting of the image forming side, if single-sided image forming is designated, the insertion sheet is reversed in the reversing section 63 and is ejected, or, if double-sided image forming is selected it is straightly ejected (FIG. 14 S15). Further, if a blank sheet insertion is designated, no image is formed but the insertion sheet merely passes through the convey path for single-sided image forming and the reversing section 63.

In this manner, the processing of carrying out double-sided copying of a document on a normal recording sheet, copying the set side of the document onto an insertion sheet, or inserting a blank insertion sheet is continued until the image forming of all the image data of the corresponding job is completed (see FIG. 14 S16).

Further, based on the result of tab detection, if it is judged that the inserted sheet has a tab and that only single-sided image forming can be done on it, even when double-sided image forming is set by the operator for the insertion sheet, only single-sided image forming is done on a priority basis, under the control of the control section 101.

In the above manner, in carrying out image forming based on image data in an image forming apparatus such as a printer, etc. by making a display prompting the operator to select the inter-sheet mode on the operation and display section 103, and by executing image forming in the inter-sheet mode, according to the settings input via the operation and display section 103, since selection of designations regarding single-sided image forming/double-sided image forming for the insertion sheet in the inter-sheet mode is input and since image forming on the recording sheets and image forming on the insertion sheets are executed as a single job, it is possible to execute efficiently without designation of the inter-sheet mode on the application program side.

Further, when a display is made prompting for the input of the selection of designation of single-sided or double-sided image forming for an insertion sheet inserted during image forming on recording sheets, and selection of the above designation is made, the image forming section is controlled so that image forming on the recording sheets and image forming on the insertion sheet are carried out as a single job. Herein, since the image forming section is controlled appropriately, in accordance with the result of detection by a tab detection section, so that single-sided image forming is carried out for the insertion sheet even when the insertion sheet is a tab sheet, it is possible to execute efficiently without designating the inter-sheet mode on the application program side.

In the above respective embodiments, although the description has been given, taking examples where the operator makes designations including various types of selections via the operation and display section 103, designations including various types of selections may also be input to an interface (I/F) 102 via a network from a computer connected to the image forming apparatus via the network. In this case, a printer driver stored in the computer preferably performs control to make the above described various displays appear on a display section connected to the computer.

What is claimed is:

1. An image forming system, comprising:

a document conveying section that conveys documents such that a front side and a back side of the documents pass through a reading position;

an image reading section for reading images on the documents conveyed to the reading position and generating image data;

an image forming section for forming images on recording media, according to the image data;

an input section for inputting designation whether the images are to be formed on both sides or on one side of the recording media; and a control section for controlling image reading by the image reading section and image forming by the image forming section, wherein the control section controls the image forming section to form images according to image data in a condition where a single job includes both single-sided image recording and double-sided image recording in a mixture, correspondingly to the designation inputted via the input section; and wherein the control section controls the image reading section to read the images on the documents in the condition where the single job includes both single-sided image reading and double-sided image reading, correspondingly to the designation of the image forming inputted via the input section.

2. The image forming system of claim 1, wherein the control section controls the image reading section to read one side of a document, when the document corresponds to a recording media page for which designation has been input via the input section to perform image recording on one side.

3. The image forming system of claim 1, comprising a plurality of trays for mounting recording media, wherein the control section selectively switches the plurality of trays, correspondingly to the designation inputted via the input section; and wherein the image forming section forms the images on recording media supplied from a tray to which the control section has switched.

4. The image forming system of claim 1, wherein the control section controls a display section to display a prompt for input of designation of single-sided image forming to be included in double-sided image forming and a prompt for input of designation of a tray for a recording medium for the single-sided image forming to be included in the double-sided image forming.

5. The image forming system of claim 4, wherein, correspondingly to the designation input, the control section controls to perform the single-sided image reading included in the double-sided image reading, to supply the recording medium from the tray designated for the single-sided image forming included in the double-sided image forming, and to perform the single-sided image forming included in the double-sided image forming.

6. An image forming system, comprising:

an image reading section for reading images on documents and generating image data;

an image forming section for forming images according to the image data on recording media;

a reverse conveying mechanism for conveying the recording media to form the images on both sides of the recording media;

a first input section for input of designation to set an inter-sheet mode for insertion of an insertion medium different from the recording media, wherein the insertion medium is inserted at least one of on a top of a bundle of image-formed recording media, at a bottom of the bundle of the recording media, and between the recording media;

a second input section for input of designation whether images are to be formed on both sides of the insertion medium, an image is to be formed on one side of the insertion medium, or no image is to be formed on the insertion medium;

a third input section for inputting designation whether images are to be formed on both sides or on one side of the recording media; and a control section for controlling the reverse conveying mechanism not to operate with respect to the insertion medium, if the designation of image forming on both sides of the recording media has been input via the third input section while the designation of image forming on one side of the insertion medium or the designation of forming no image on the insertion medium has been input via the second input section.

7. The image forming system of claim 6, wherein the designation via the third input section can be input for each page.

8. The image forming system of claim 6, wherein the second input section receives the input of designation with respect to the insertion medium, according to a type of the insertion medium.

9. The image forming system of claim 8, wherein the type of the insertion medium includes at least one of preprinted medium, paperboard, and tab paper.

10. The image forming system of claim 6, comprising:

a document conveying section which conveys documents so that a front side and a back side of the documents passes through a reading position, wherein the control section determines whether or not to operate the reverse conveying mechanism with respect to the insertion medium, according to the designation inputted via the second input section.

11. The image forming system of claim 10, wherein the control section controls single-sided reading to be performed with respect to the insertion sheet if single-sided image forming has been designated for the insertion sheet via the second input section.

12. An image forming system comprising:

an image forming section for forming images on recording media selectively supplied from one of a plurality of trays;

a first input section for input of designation to set an inter-sheet mode for inserting an insertion medium different from the recording media, wherein the insertion medium is inserted at least one of on a top of a bundle of image formed recording media, at a bottom of the bundle of the recording media, and between the recording media;

a display section;

a second input section for input of designation whether an image is to be formed on one side of the insertion medium or images are to be formed on both sides of the insertion medium; and a control section for controlling image forming in the image forming section, wherein the control section controls the display section to display a prompt for input to the second input section, in response to the designation inputted to set the inter-sheet mode via the first input section; and wherein the control section controls the image forming section to perform image forming on the insertion medium, correspondingly to the designation inputted via the second input section.

13. The image forming system of claim 12, comprising a third input section for inputting designation whether an image is to be formed on one side or images are to be formed on both sides of the recording media, wherein the control section controls the image forming section to perform image forming on the recording mediums, correspondingly to the designation inputted via the third input section.

14. The image forming system of claim 13, wherein the control section controls the image forming section to perform image forming on the recording media and the insertion medium as a single job, correspondingly to the designation inputted via the first input section, the designation inputted via the second input section, and the designation inputted via the third input section.

15. The image forming system of claim 12, comprising a tab detecting section for detecting a tab of the insertion medium, wherein the control section controls the image forming section to make image forming on the insertion medium to be image forming on one side, correspondingly to a detection result by the tab detecting section.

* * * * *